US011566624B2

(12) United States Patent
Seibel et al.

(10) Patent No.: US 11,566,624 B2
(45) Date of Patent: Jan. 31, 2023

(54) COMPRESSOR HAVING LUBRICATION SYSTEM

(71) Applicant: Emerson Climate Technologies, Inc., Sidney, OH (US)

(72) Inventors: Stephen M. Seibel, Celina, OH (US); Natalie M. Gehret, Yorkshire, OH (US); Richard A. Kice, Tipp City, OH (US)

(73) Assignee: Emerson Climate Technologies, Inc., Sidney, OH (US)

( * ) Notice: Subject to any disclaimer, the term of this patent is extended or adjusted under 35 U.S.C. 154(b) by 72 days.

(21) Appl. No.: 17/076,582

(22) Filed: Oct. 21, 2020

(65) Prior Publication Data

US 2022/0120277 A1 Apr. 21, 2022

(51) Int. Cl.
*F04C 29/02* (2006.01)
*F04C 18/02* (2006.01)

(52) U.S. Cl.
CPC ..... *F04C 29/02* (2013.01); *F04C 18/0215* (2013.01); *F04C 18/0246* (2013.01);
(Continued)

(58) Field of Classification Search
CPC .. F04C 29/02; F04C 18/0215; F04C 18/0246; F04C 18/0253; F04C 29/023;
(Continued)

(56) References Cited

U.S. PATENT DOCUMENTS 4,516,916 A 5/1985 English et al.
4,596,521 A * 6/1986 Murayama ..... F01C 1/0215 418/55.6

(Continued)

FOREIGN PATENT DOCUMENTS

CN 201297252 Y 8/2009
EP 0816684 A1 * 1/1998

(Continued)

OTHER PUBLICATIONS

International Search Report regarding Application No. PCT/US2021/055846 dated Feb. 17, 2022.

(Continued)

*Primary Examiner* — Dominick L Plakkoottam
*Assistant Examiner* — Paul W Thiede
(74) *Attorney, Agent, or Firm* — Harness, Dickey & Pierce, P.L.C.

(57) ABSTRACT

A compressor includes first and second scroll members and a bearing housing. The first scroll member includes a first end plate and a first scroll wrap. The second scroll member includes a second end plate that has a first surface, a second surface, and an oil passage. The first surface has a second scroll wrap meshingly engaging the first scroll wrap. The second surface includes an oil slot. The oil passage is in fluid communication with the oil slot. The bearing housing cooperates with the second scroll member to define an interior volume. The second scroll member is movable between a first position in which lubricant in the interior volume is allowed to flow into the oil passage via the oil slot, and a second position in which working fluid in the chamber is allowed to flow into the oil passage via the oil slot.

9 Claims, 27 Drawing Sheets

(52) U.S. Cl.
CPC ..... *F04C 18/0253* (2013.01); *F04C 29/023* (2013.01); *F04C 29/025* (2013.01); *F04C 29/028* (2013.01); *F04C 2210/206* (2013.01); *F04C 2210/22* (2013.01); *F04C 2240/50* (2013.01); *F04C 2240/603* (2013.01)

(58) Field of Classification Search
CPC ..... F04C 29/028; F04C 2210/206; F04C 2210/22; F04C 2240/50; F04C 29/025
See application file for complete search history.

(56) References Cited

U.S. PATENT DOCUMENTS

| | | | | |
|---|---|---|---|---|
| 4,846,633 | A | 7/1989 | Suzuki et al. | |
| 5,013,225 | A | 5/1991 | Richardson, Jr. | |
| 5,137,437 | A * | 8/1992 | Machida | F04C 29/0021 384/209 |
| 5,222,874 | A | 6/1993 | Unnewehr et al. | |
| 5,249,941 | A * | 10/1993 | Shibamoto | F04C 29/0035 418/55.6 |
| 5,370,513 | A | 12/1994 | Fain | |
| 5,372,490 | A | 12/1994 | Fain | |
| 5,395,224 | A | 3/1995 | Caillat et al. | |
| 5,713,731 | A | 2/1998 | Utter et al. | |
| 6,071,100 | A | 6/2000 | Yamada et al. | |
| 6,074,186 | A | 6/2000 | Lifson et al. | |
| 6,077,057 | A | 6/2000 | Hugenroth et al. | |
| 6,257,840 | B1 | 7/2001 | Ignatiev et al. | |
| 6,422,843 | B1 | 7/2002 | Sun et al. | |
| 6,616,415 | B1 | 9/2003 | Renken et al. | |
| 6,655,932 | B1 | 12/2003 | Stinessen et al. | |
| 7,878,780 | B2 | 2/2011 | Bush et al. | |
| 8,133,043 | B2 | 3/2012 | Duppert | |
| 8,215,933 | B2 | 7/2012 | Kim et al. | |
| 8,590,324 | B2 | 11/2013 | Guo et al. | |
| 8,961,158 | B2 | 2/2015 | Oka et al. | |
| 9,127,669 | B2 | 9/2015 | Tsuka et al. | |
| 9,239,054 | B2 | 1/2016 | Ignatiev et al. | |
| 9,903,370 | B2 | 2/2018 | Tsuka et al. | |
| 10,480,509 | B2 | 11/2019 | Murakami et al. | |
| 10,519,954 | B2 * | 12/2019 | Berning | F04C 18/0261 |
| 2009/0087320 | A1 | 4/2009 | Tanaka et al. | |
| 2009/0090117 | A1 | 4/2009 | McSweeney | |
| 2010/0028165 | A1 | 2/2010 | Kameya et al. | |
| 2012/0189472 | A1 | 7/2012 | McDonald | |
| 2012/0224990 | A1 | 9/2012 | Shiibayashi et al. | |
| 2013/0078131 | A1 | 3/2013 | Ahn et al. | |
| 2014/0053587 | A1 | 2/2014 | Arii | |
| 2014/0138451 | A1 | 5/2014 | Pham | |
| 2016/0298627 | A1 | 10/2016 | Knippen et al. | |
| 2016/0319816 | A1 | 11/2016 | Brostrom et al. | |
| 2018/0080448 | A1 | 3/2018 | Ma et al. | |
| 2020/0157982 | A1 | 5/2020 | Groshek | |

FOREIGN PATENT DOCUMENTS

| | | | |
|---|---|---|---|
| EP | 1698783 | A1 | 9/2006 |
| EP | 3604816 | A1 | 2/2020 |
| JP | H05172077 | A | 7/1993 |
| JP | 2631649 | B2 | 7/1997 |
| JP | 2007232230 | A | 9/2007 |
| JP | 2011012629 | A | 1/2011 |
| JP | 2011012633 | A | 1/2011 |
| JP | 2014190271 | A | 10/2014 |
| WO | WO-2018174100 | A1 | 9/2018 |

OTHER PUBLICATIONS

Written Opinion of the ISA regarding Application No. PCT/US2021/055846 dated Feb. 17, 2022.
"Application guidelines: Inverter scroll compressors VZH088-117-170 single, R410A." Danfoss Commercial Compressors, Jan. 2017, http://files.danfoss.com/technicalinfo/dila/17/FRCC.PC.023.A8.02-VZH088-117-170-Jan2017.pdf.
International Search Report regarding International Application No. PCT/US2013/067476, dated Feb. 11, 2014.
Written Opinion of the International Searching Authority regarding International Application No. PCT/US2013/067476, dated Feb. 11, 2014.
Office Action regarding U.S. Appl. No. 14/063,056, dated Jun. 4, 2015.
Office Action regarding U.S. Appl. No. 14/063,056, dated Sep. 11, 2015.
Office Action regarding Chinese Patent Application No. 201380060605.3, dated May 27, 2016. Translation provided by Unitalen Attorneys at Law.
Search Report regarding European Patent Application No. 19210166.5, dated Apr. 17, 2020.
Restriction Requirement regarding U.S. Appl. No. 16/252,035, dated Oct. 21, 2020.
Office Action regarding U.S. Appl. No. 16/252,035, dated Feb. 10, 2021.
Office Action regarding U.S. Appl. No. 16/252,035, dated May 28, 2021.

* cited by examiner

COMPRESSOR HAVING LUBRICATION SYSTEM

FIELD

The present disclosure relates to a compressor having a lubrication system.

BACKGROUND

This section provides background information related to the present disclosure and is not necessarily prior art.

A climate-control system such as, for example, a heat-pump system, a refrigeration system, or an air conditioning system, may include a fluid circuit having an outdoor heat exchanger, an indoor heat exchanger, an expansion device disposed between the indoor and outdoor heat exchangers, and one or more compressors circulating a working fluid (e.g., refrigerant or carbon dioxide) between the indoor and outdoor heat exchangers. Efficient and reliable operation of the one or more compressors is desirable to ensure that the climate-control system in which the one or more compressors are installed is capable of effectively and efficiently providing a cooling and/or heating effect on demand.

SUMMARY

This section provides a general summary of the disclosure, and is not a comprehensive disclosure of its full scope or all of its features.

In one form, the present disclosure discloses a compressor that includes a shell, a first scroll member, a second scroll member, and a bearing housing. The shell defines a chamber. The first scroll member is disposed within the chamber and includes a first end plate and a first scroll wrap extending therefrom. The second scroll member is disposed within the chamber and includes a second end plate having a first surface, a second surface, and an oil passage. The first surface has a second scroll wrap meshingly engaging the first scroll wrap to define fluid pockets therebetween. The second surface is opposite the first surface and includes an oil slot. The oil passage is in fluid communication with the oil slot and one of the fluid pockets. The bearing housing axially supports the second scroll member and cooperates with the second scroll member to define an interior volume. The second scroll member is movable between a first position in which lubricant in the interior volume is allowed to flow into the oil passage via the oil slot, and a second position in which lubricant in the interior volume is restricted from flowing to the oil passage via the oil slot.

In some configurations of the compressor of the above paragraph, the oil slot surrounds the oil passage.

In some configurations of the compressor of any one or more of the above paragraphs, a diameter of the oil passage is less than a thickness of the first scroll wrap.

In some configurations of the compressor of any one or more of the above paragraphs, a width of the oil slot is greater than a diameter of the oil passage.

In some configurations of the compressor of any one or more of the above paragraphs, an outlet of the oil passage is positioned at an outer end of the second scroll wrap.

In some configurations of the compressor of any one or more of the above paragraphs, the oil passage is in selective fluid communication with a suction pocket of the fluid pockets.

In some configurations of the compressor of any one or more of the above paragraphs, the interior volume is in fluid communication with the oil slot during a selected portion of a compression cycle of the first and second scroll members.

In some configurations of the compressor of any one or more of the above paragraphs, the first scroll wrap is positioned over the oil passage when the second scroll member is in the first position to prevent lubricant in the oil passage from entering into the fluid pockets.

In some configurations of the compressor of any one or more of the above paragraphs, the second scroll member includes a hub extending from the second surface of the second end plate. The hub and the bearing housing cooperate to define the interior volume. The oil slot and the oil passage are positioned radially outwardly relative to the hub.

In some configurations of the compressor of any one or more of the above paragraphs, the oil slot and the oil passage are positioned radially inwardly relative to an outer diametrical surface of the second end plate.

In some configurations of the compressor of any one or more of the above paragraphs, an end portion of the first scroll wrap includes a notch formed therein. The oil passage is in fluid communication with one of the fluid pockets via the notch when the end portion of the first scroll wrap is positioned over the oil passage.

In some configurations of the compressor of any one or more of the above paragraphs, the fluid pocket is a suction pocket. An outlet of the oil passage is positioned upstream of the suction pocket.

In some configurations of the compressor of any one or more of the above paragraphs, a plurality of oil passages are in fluid communication with the oil slot and in fluid communication with the fluid pocket.

In another form, the present disclosure provides a compressor that includes a shell, a first scroll member, a second scroll member, and a bearing housing. The shell defines a chamber. The first scroll member is disposed within the chamber and includes a first end plate and a first scroll wrap extending therefrom. The second scroll member is disposed within the chamber and includes a second end plate, a second scroll wrap extending from the second end plate, and first and second oil passages. The second end plate has a first surface and a second surface opposite the first surface. The second scroll wrap meshingly engages the first scroll wrap to define fluid pockets therebetween. The first and second oil passages are formed in the second end plate. The bearing housing axially supports the second scroll member and cooperates with the second scroll member to define an interior volume. A first oil aperture is formed in the second surface of the second end plate and is in fluid communication with the first oil passage. The first oil aperture surrounds the first oil passage and the first oil passage is in selective fluid communication with the interior volume via the first oil aperture. A second oil aperture is formed in the second surface of the second end plate and is in fluid communication with the second oil passage. The second oil aperture surrounds the second oil passage and the second oil passage is in selective fluid communication with the interior volume via the second oil aperture.

In some configurations of the compressor of the above paragraph, a diameter of each of the first and second oil passages are less than a thickness of the second scroll wrap.

In some configurations of the compressor of any one or more of the above paragraphs, the first and second oil passages are diametrically opposed to each other.

In some configurations of the compressor of any one or more of the above paragraphs, when the second scroll member is in a first position, the first oil passage is in fluid communication with a first suction pocket of the fluid pockets. When the second scroll member is in a second position, the second oil passage is in fluid communication with a second suction pocket of the fluid pockets.

In some configurations of the compressor of any one or more of the above paragraphs, the first and second oil passages are adjacent to each other.

In some configurations of the compressor of any one or more of the above paragraphs, when the second scroll member is in a first position, the first oil passage is in fluid communication with a suction pocket of the fluid pockets and the second oil passage is fluidly isolated from the suction pocket. When the second scroll member is in a second position, the second oil passage is in fluid communication the suction pocket and the first oil passage is fluidly isolated from the suction pocket.

In some configurations of the compressor of any one or more of the above paragraphs, when the second scroll member is in the first position, the first oil aperture is fluidly isolated from the chamber and the second oil aperture is in fluid communication with the chamber. When the second scroll member is in a second position, the second oil aperture is fluidly isolated from the chamber and the first oil aperture is in fluid communication with the chamber.

In some configurations of the compressor of any one or more of the above paragraphs, the chamber is a suction chamber.

In some configurations of the compressor of any one or more of the above paragraphs, when the second scroll member is in a first position, lubricant in the interior volume is allowed to flow into the first oil passage and the second oil passage.

In some configurations of the compressor of any one or more of the above paragraphs, when the second scroll member is in a first position, working fluid in the chamber is allowed to flow into the first oil passage and the second oil passage.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected embodiments and not all possible implementations, and are not intended to limit the scope of the present disclosure.

Figure 1:
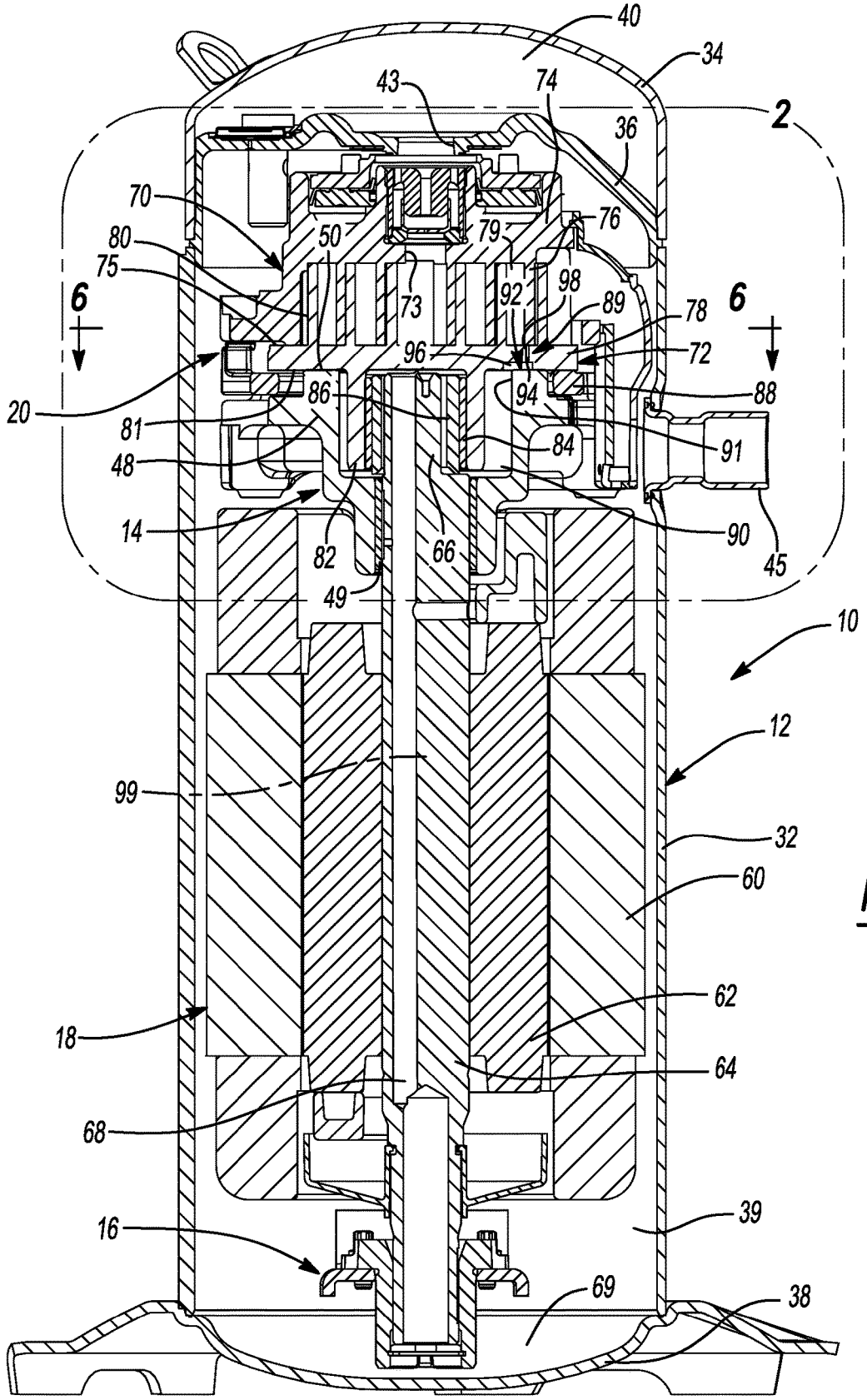
FIG. 1 is a section view of a compressor according to the present disclosure.
Figure 8:
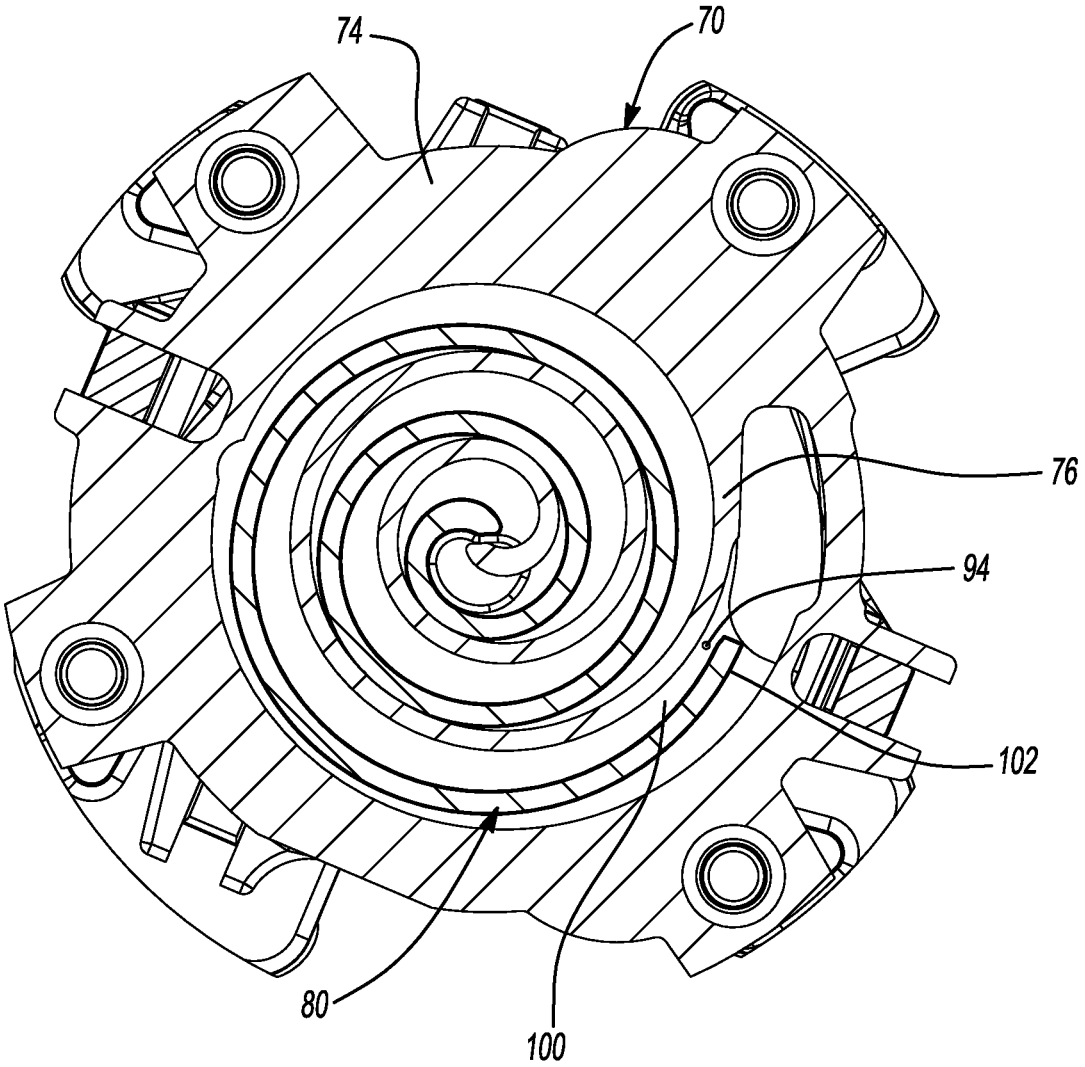
FIG. 8 is a cross-sectional view of the compressor of FIG. 7.
Figure 8A:
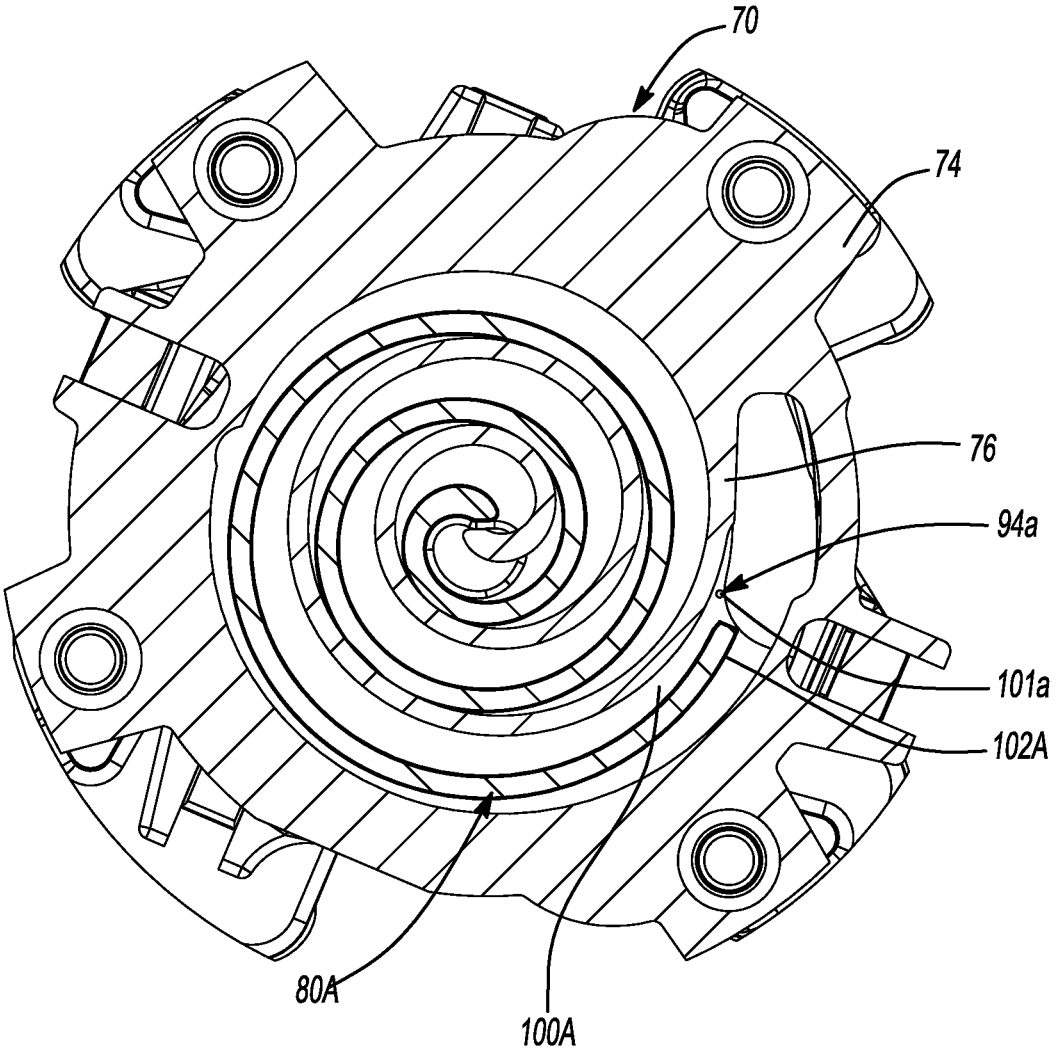
Figure 9:
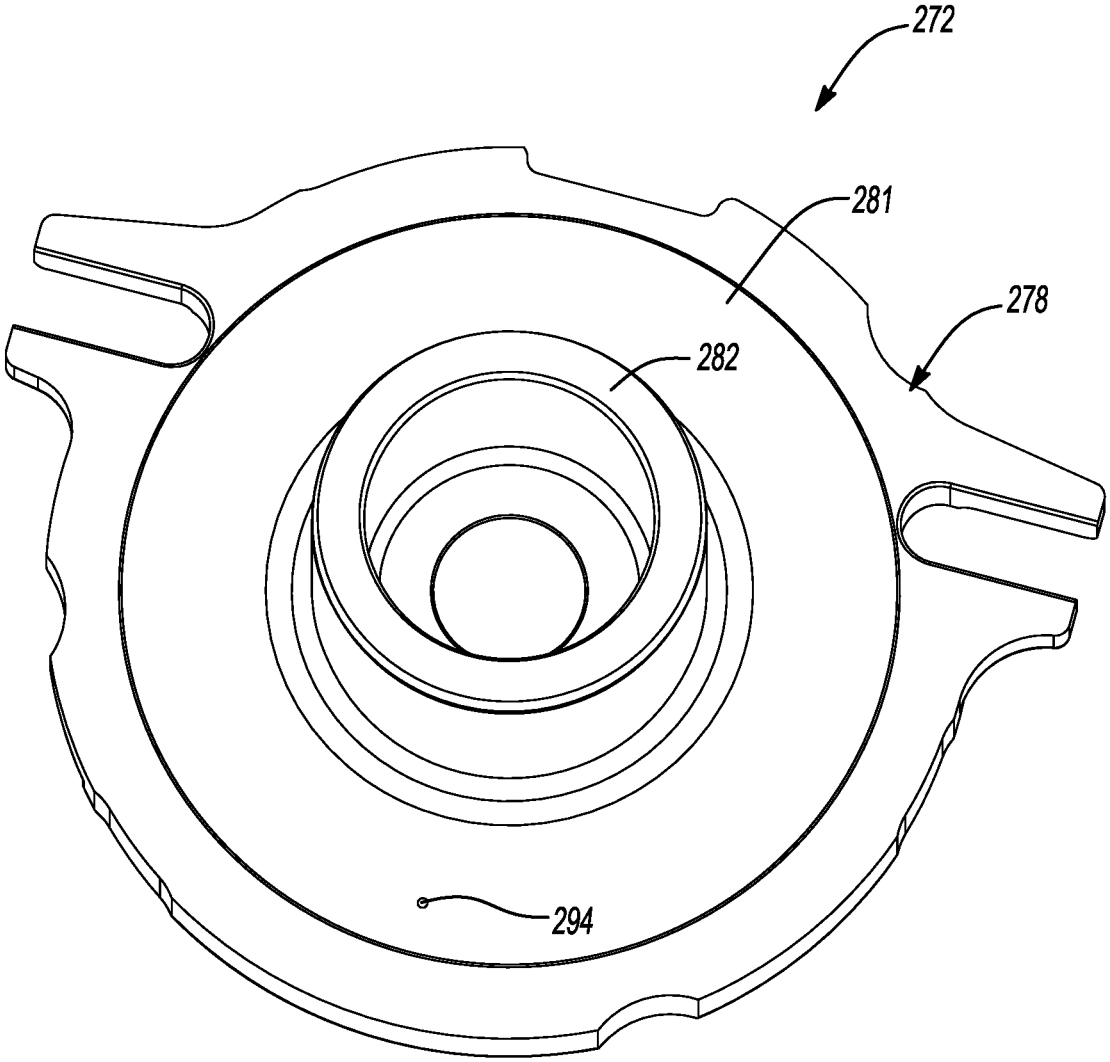
Figure 10:
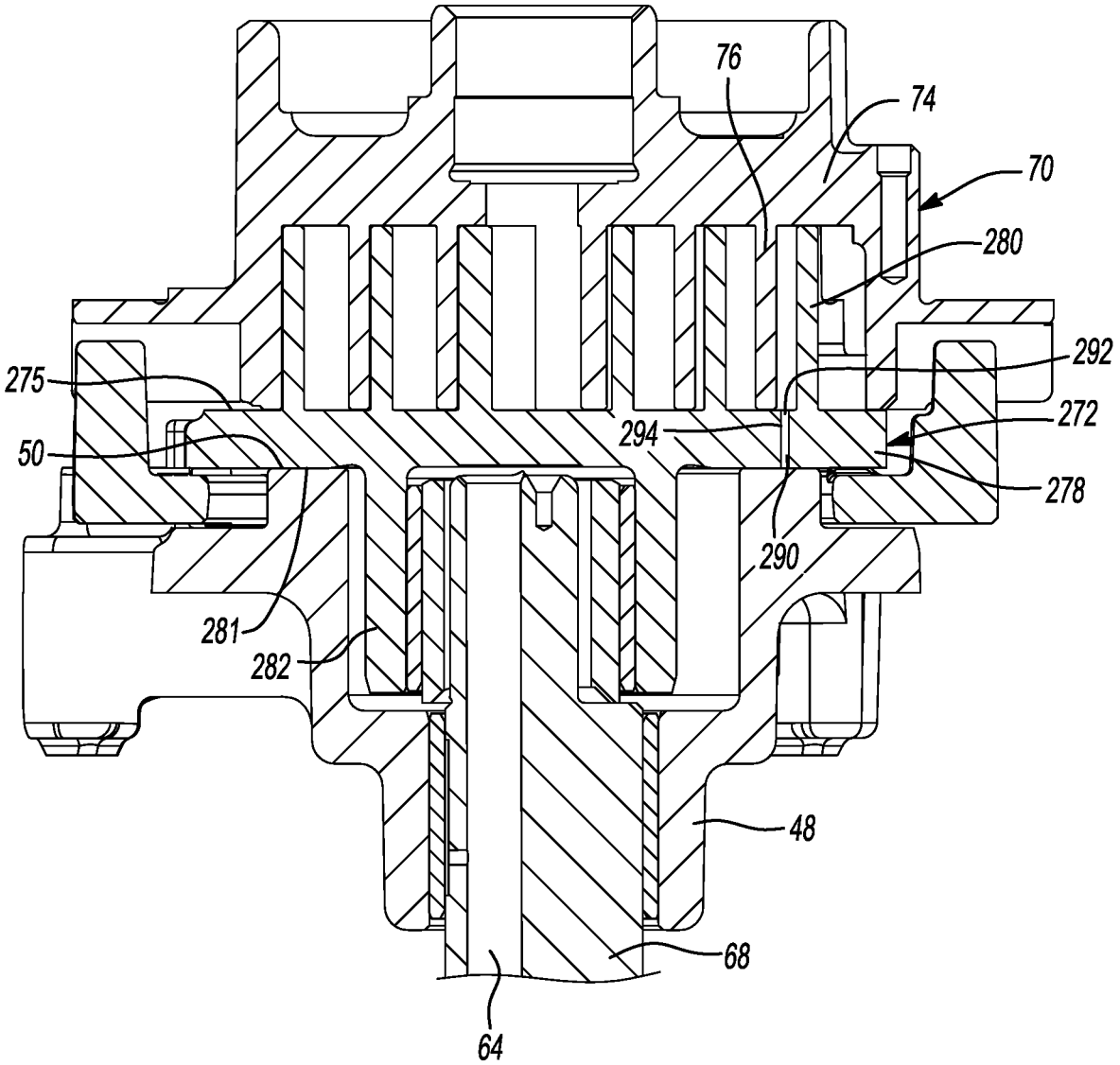
Figure 11:
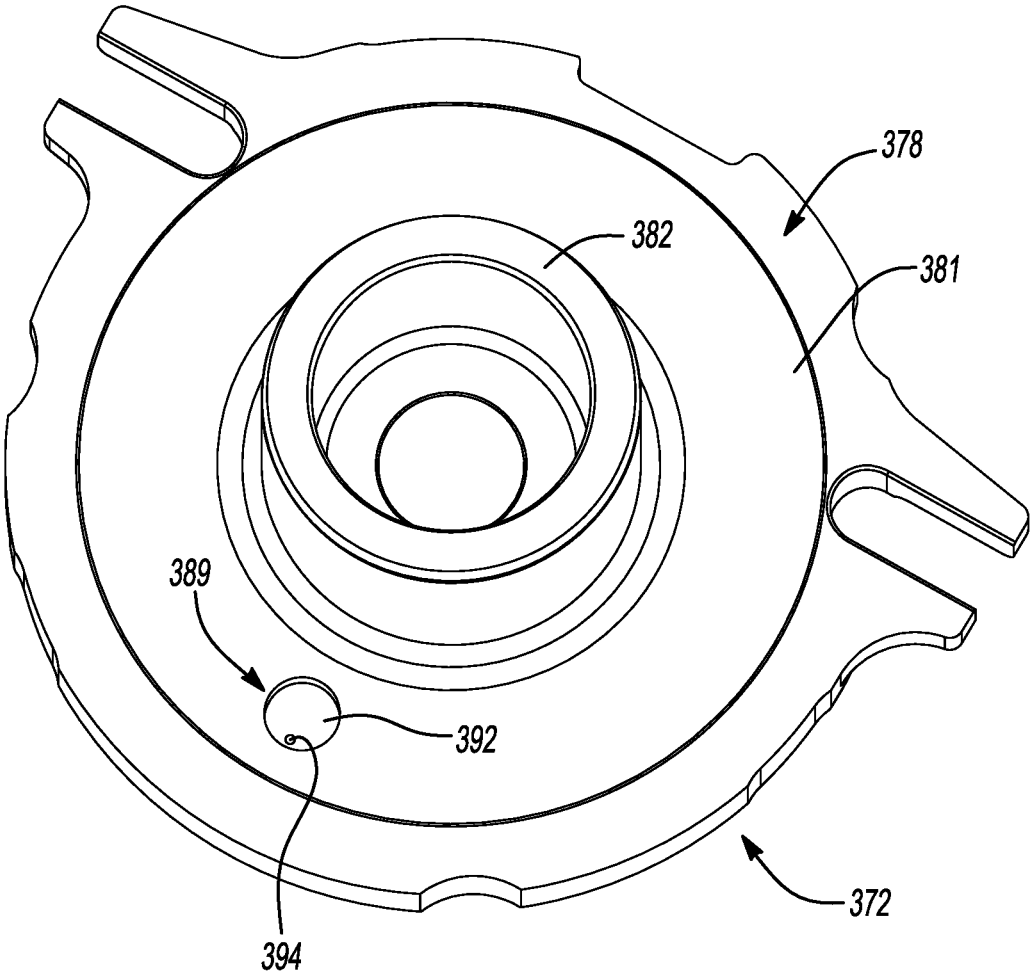
Figure 12:
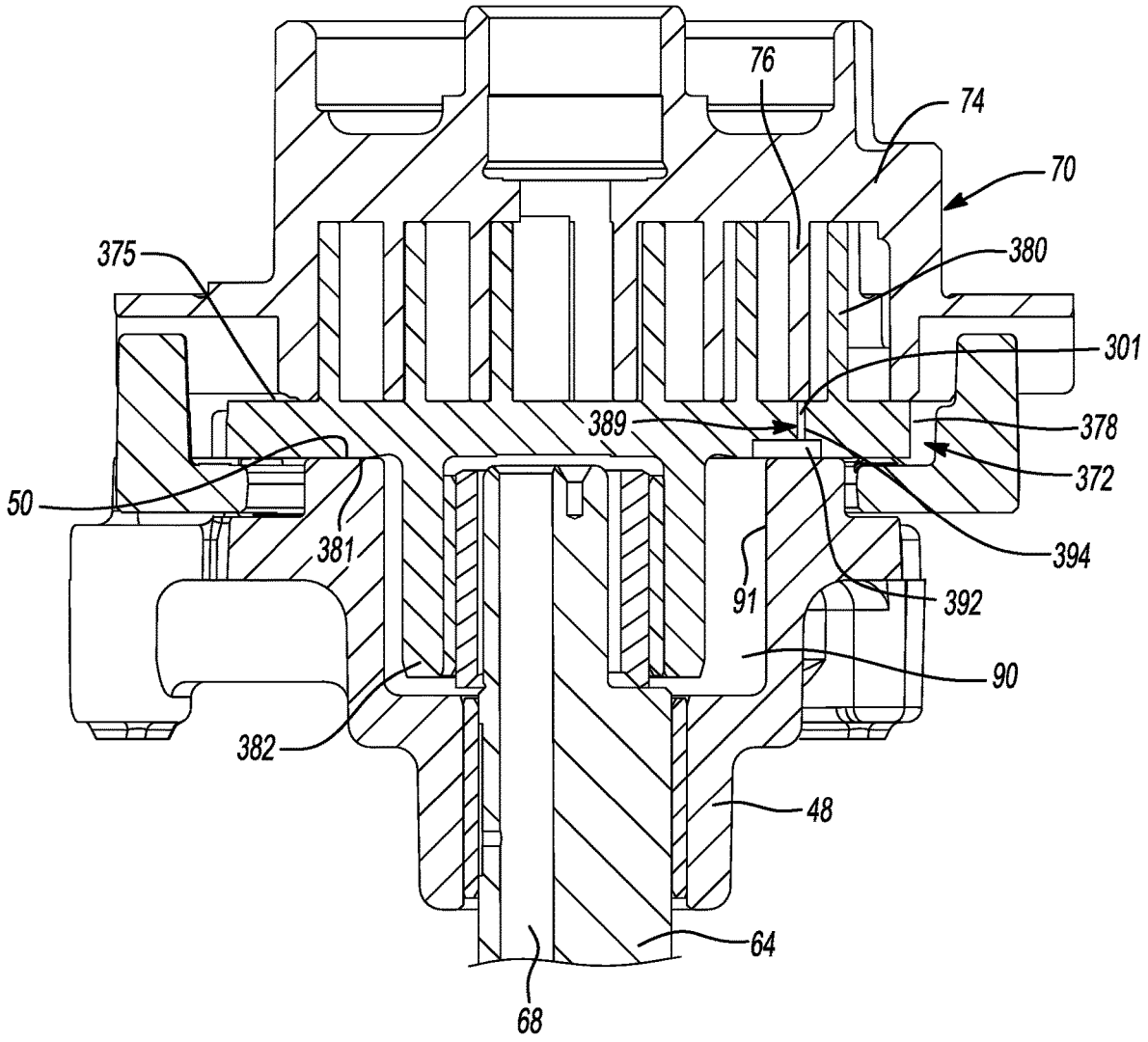
Figure 12A:
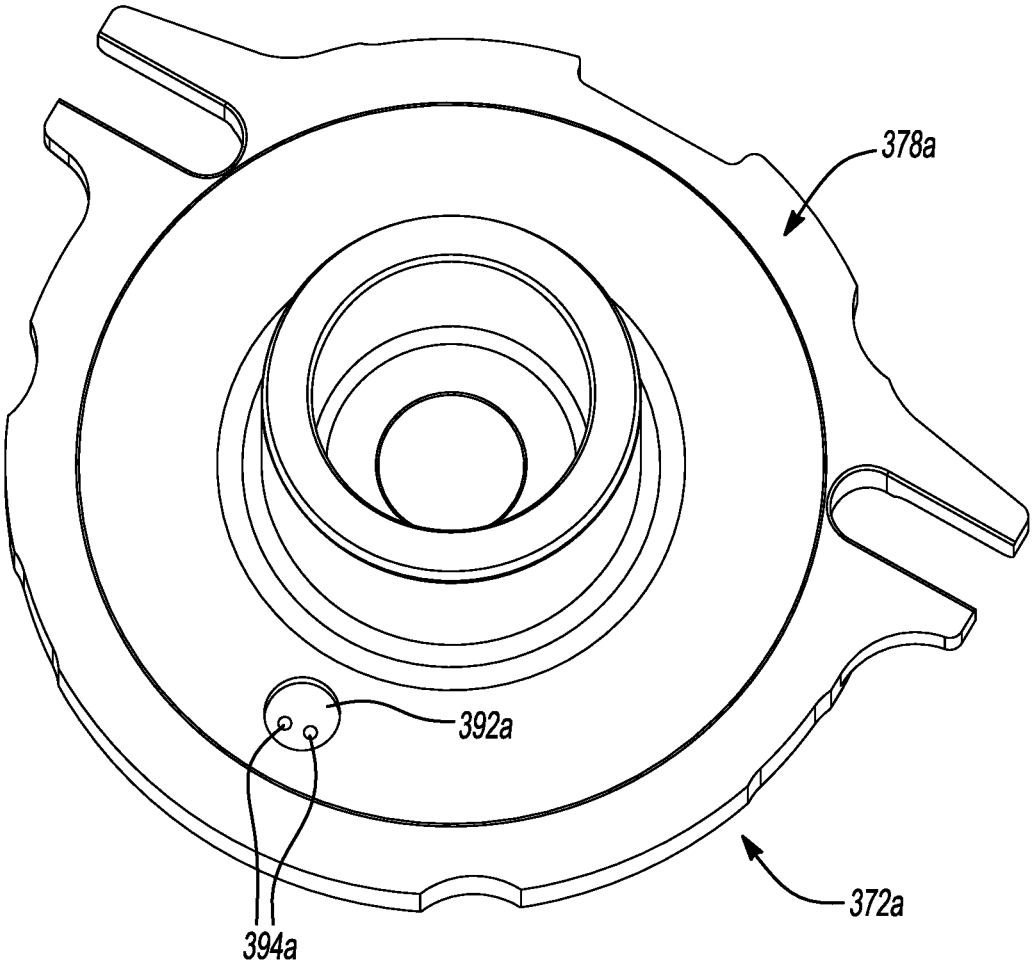
Figure 13:
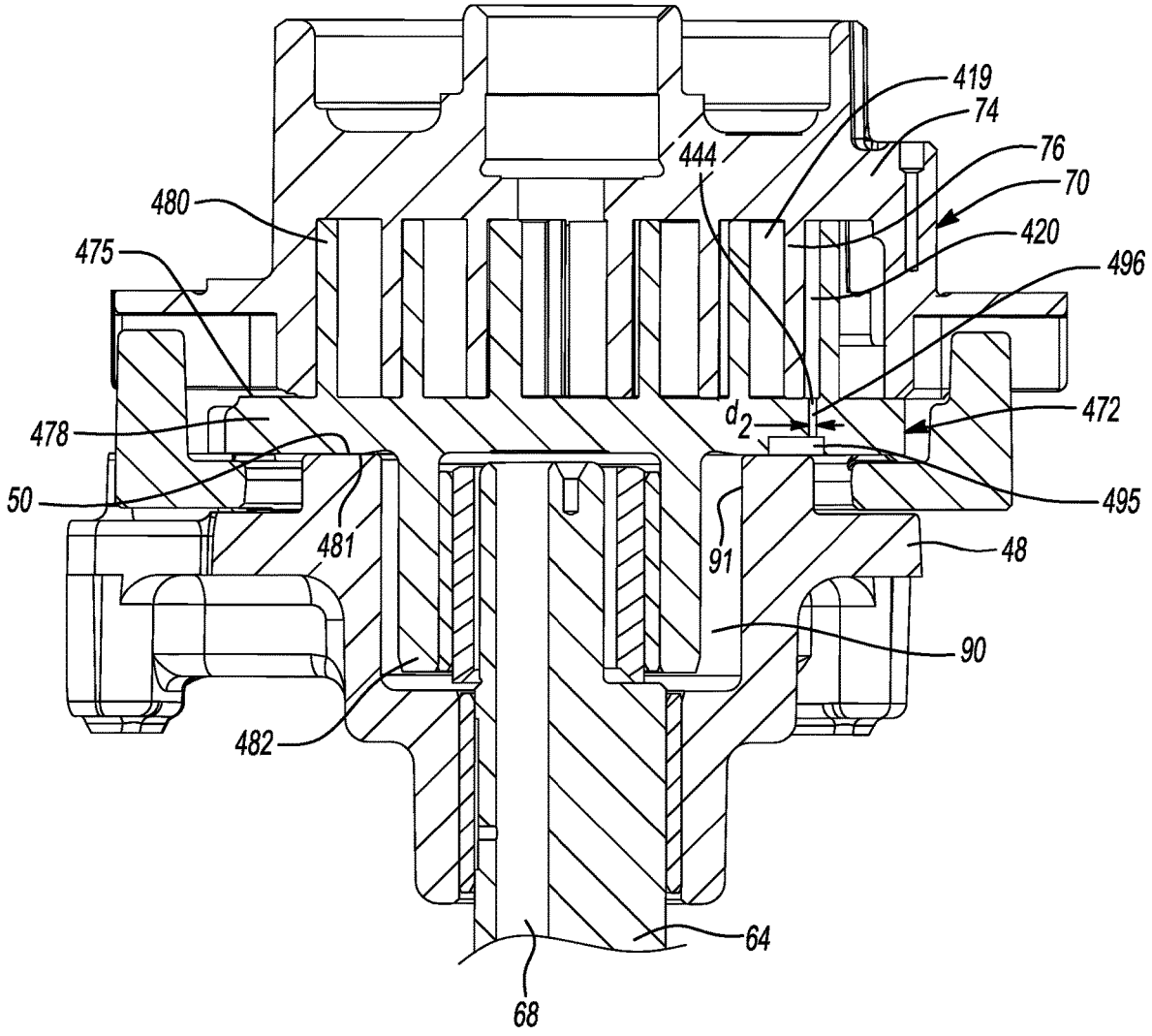
Figure 13A:
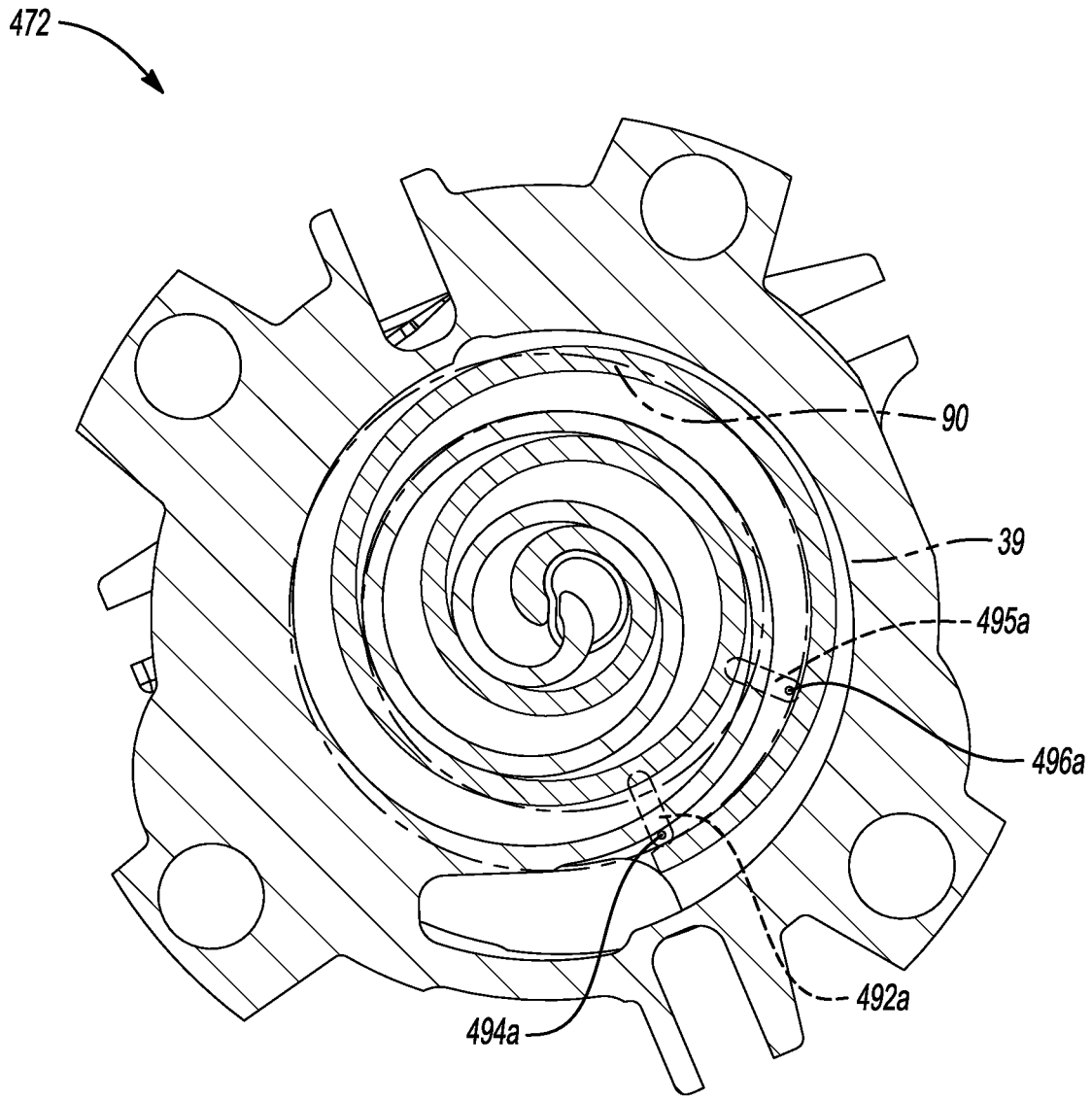
Figure 13B:
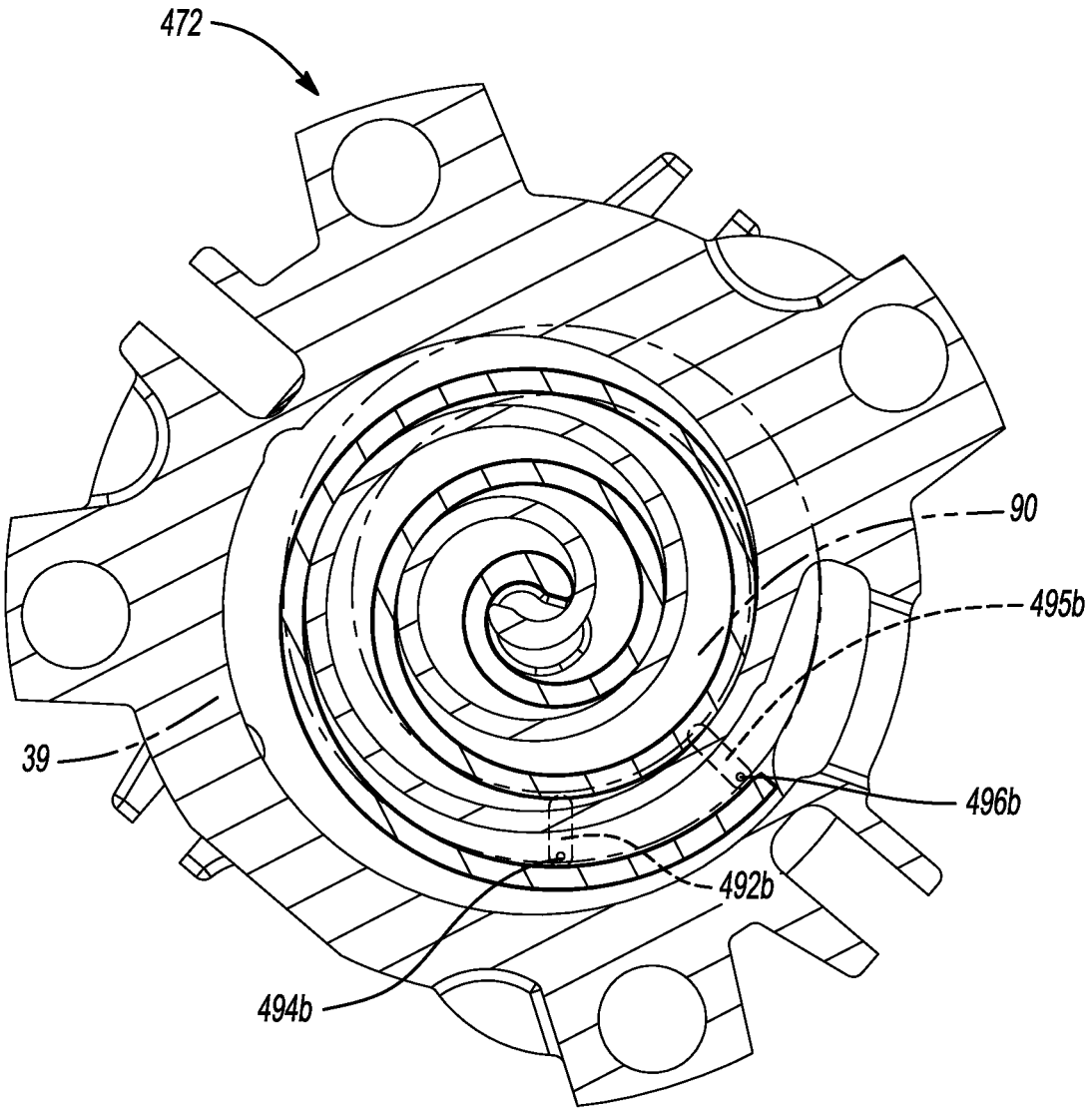
Figure 14:
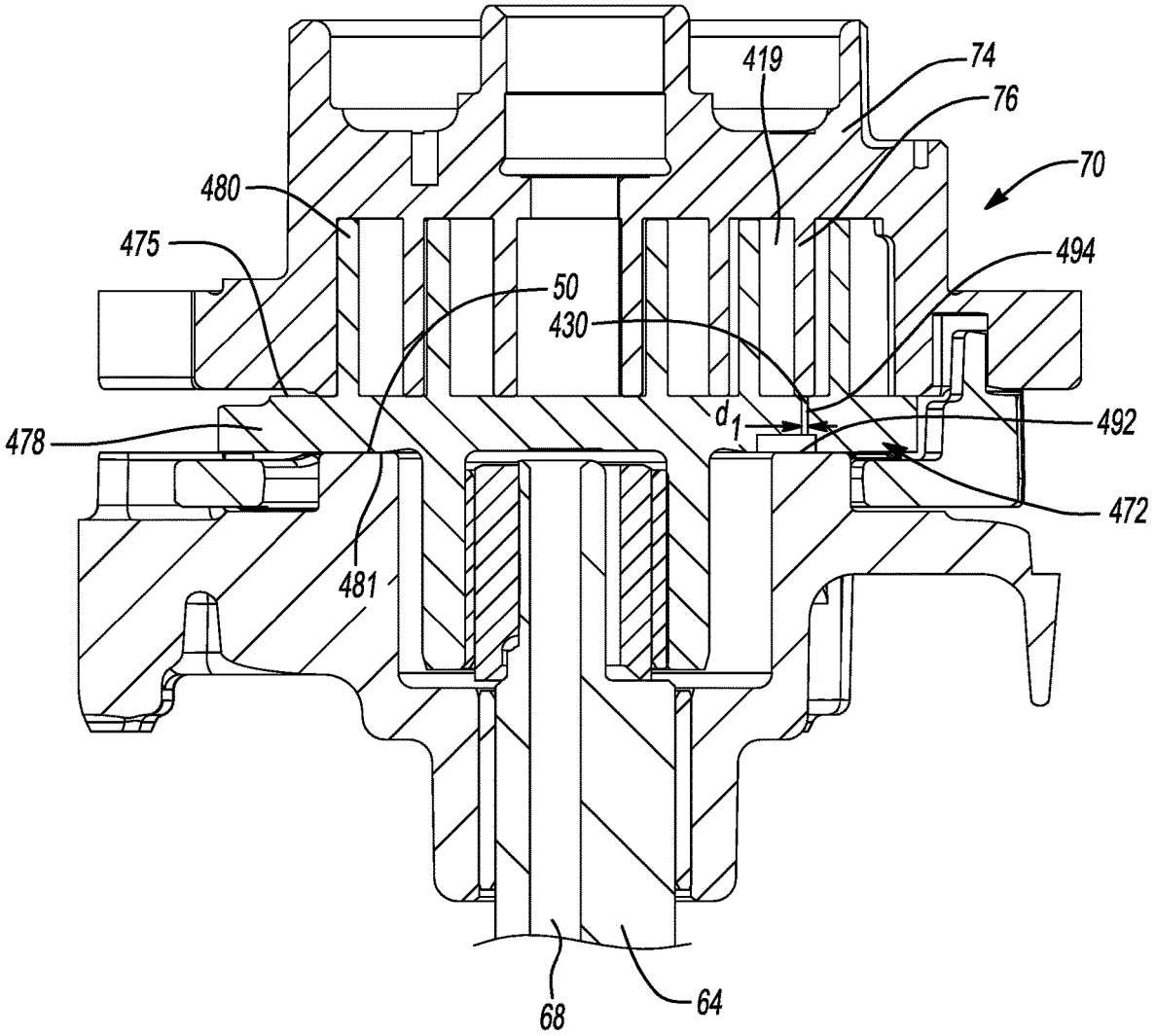
Figure 15:
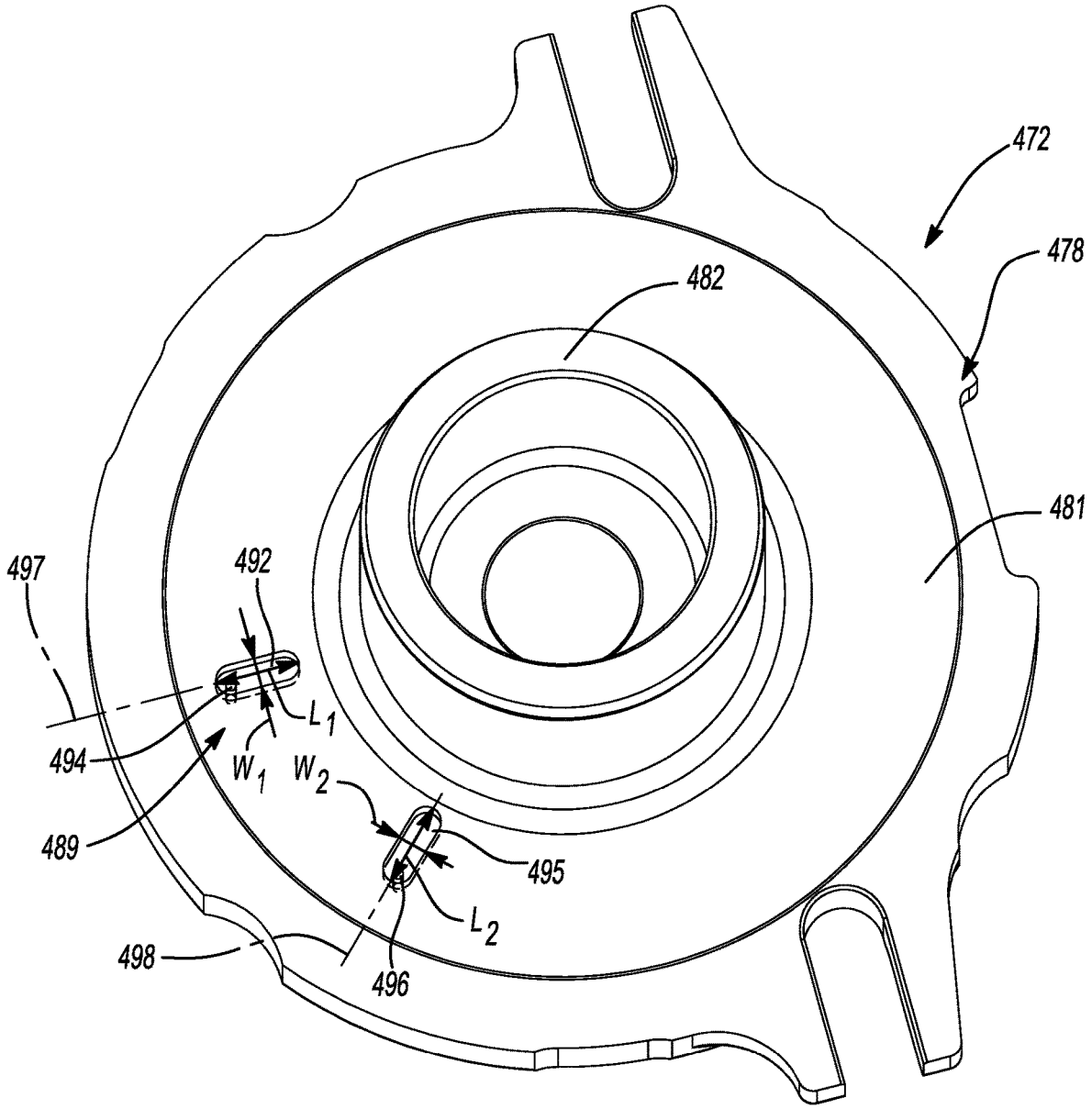
Figure 16:
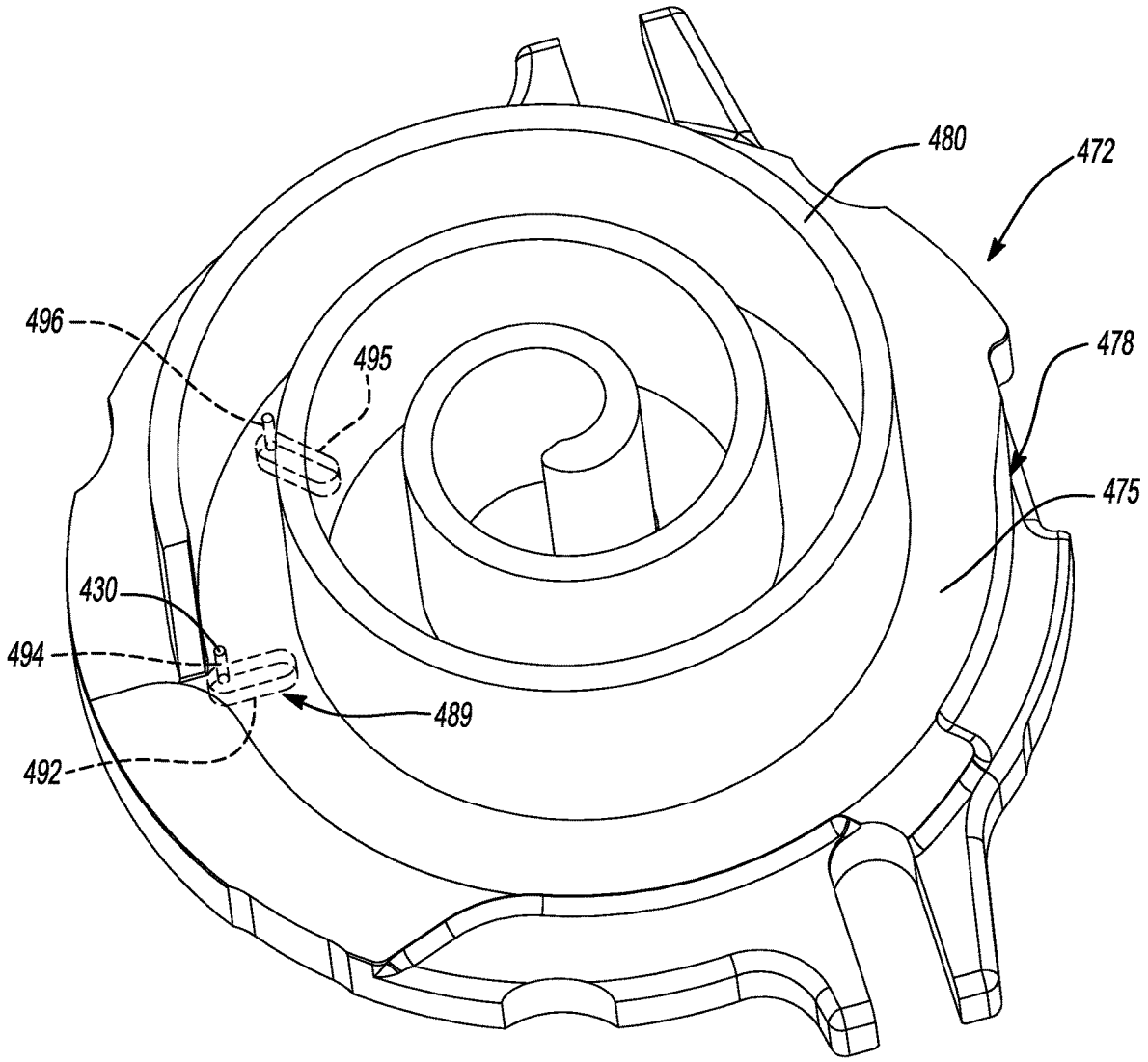
Figure 17:
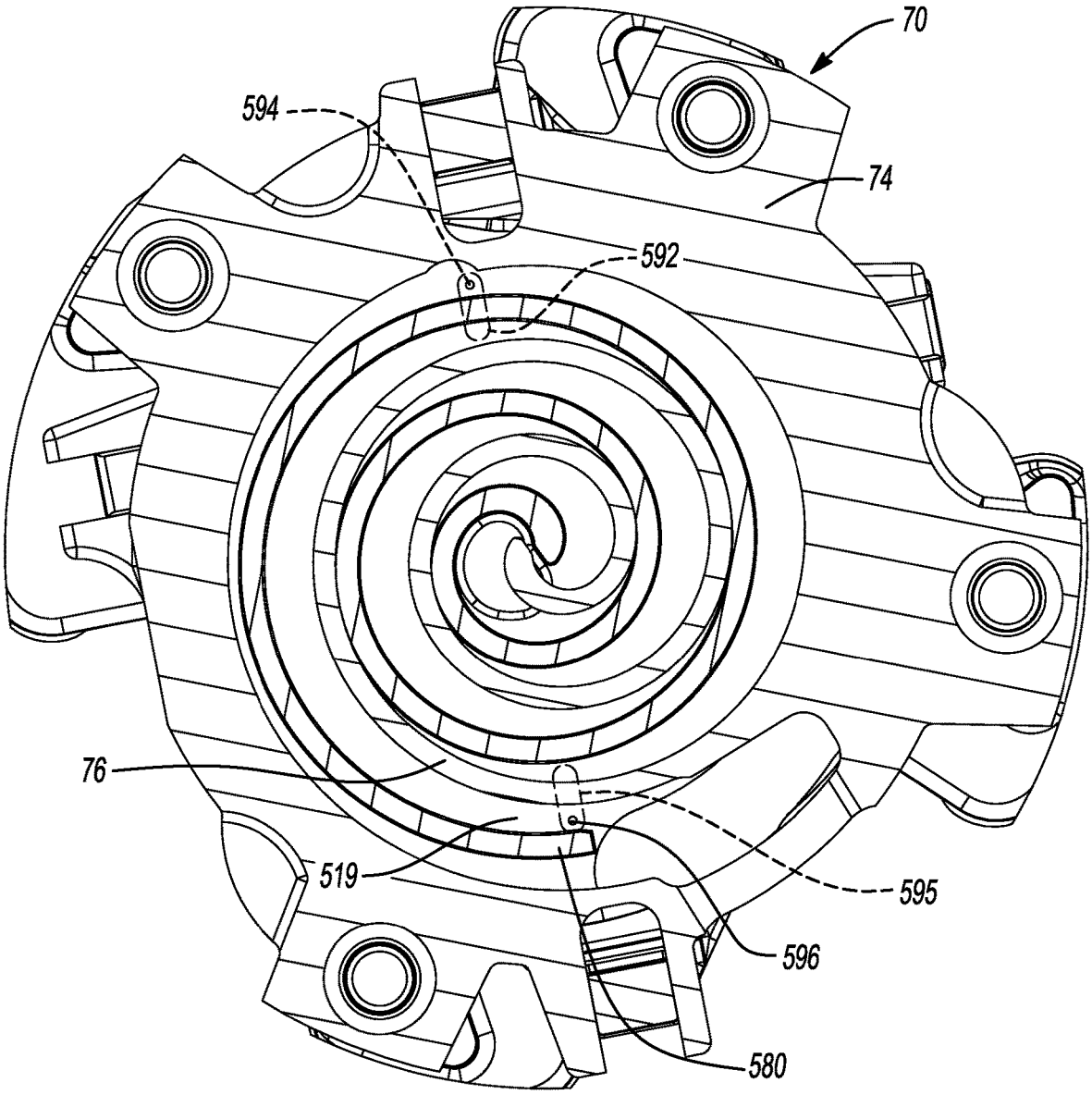
Figure 17A:
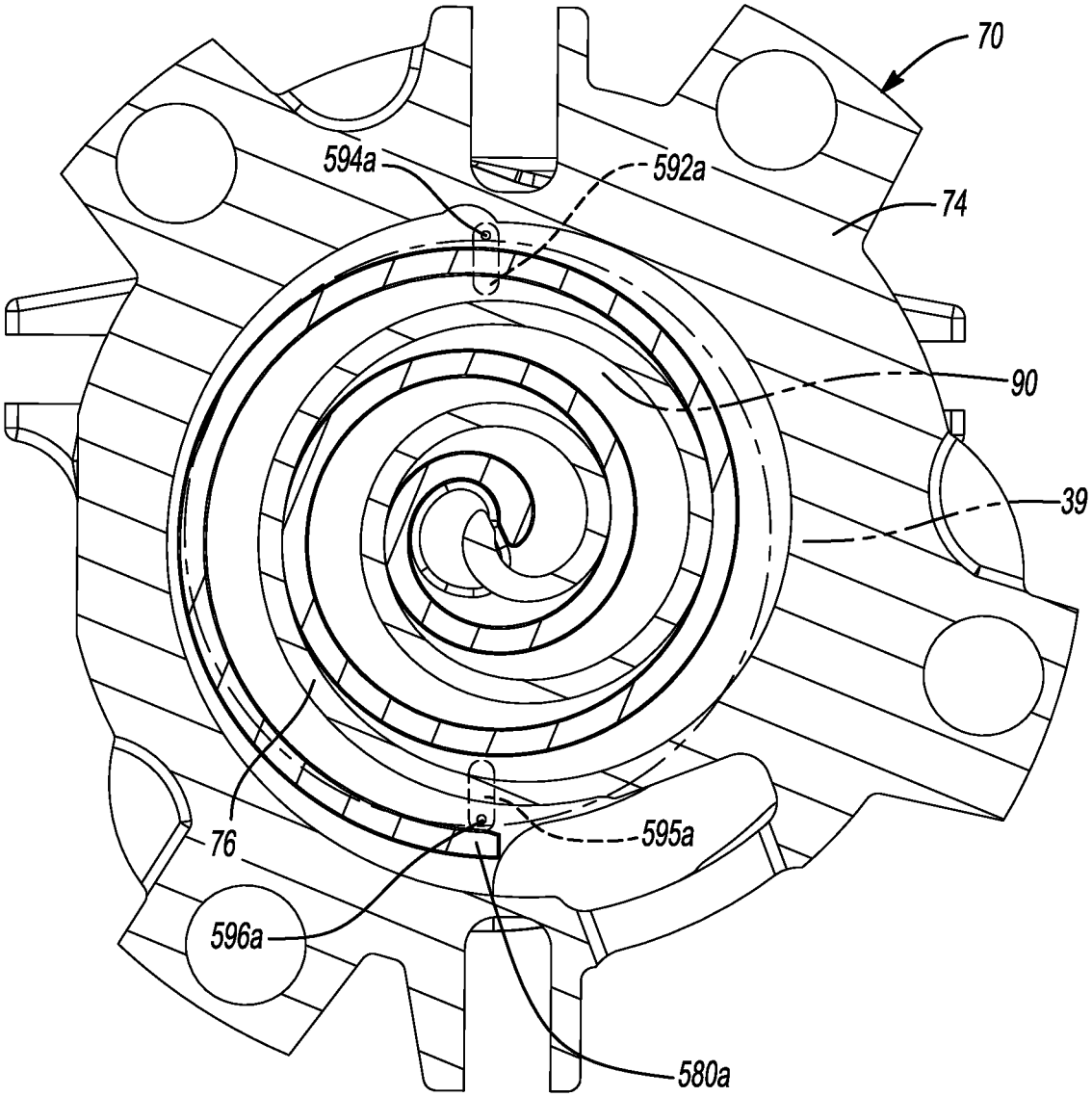
Figure 18:
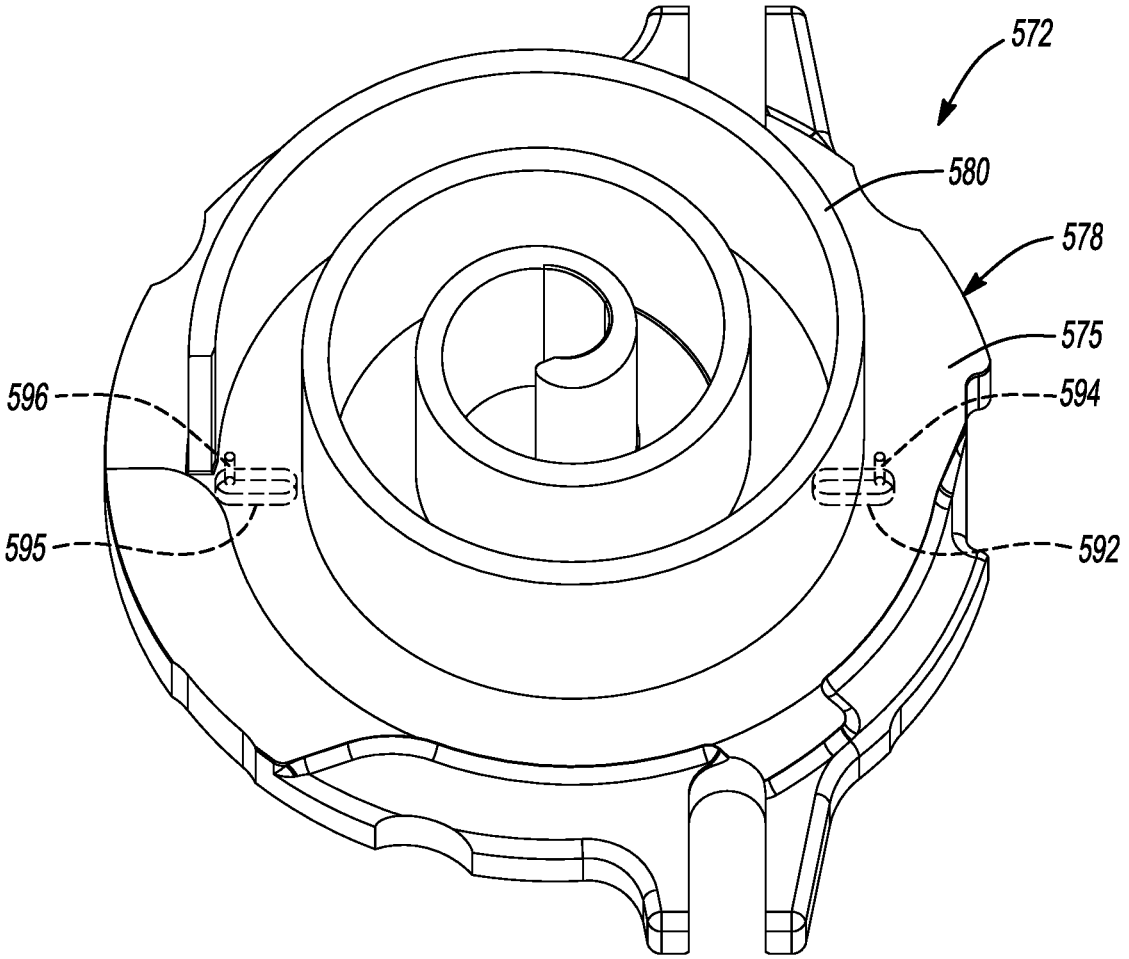
Figure 19:
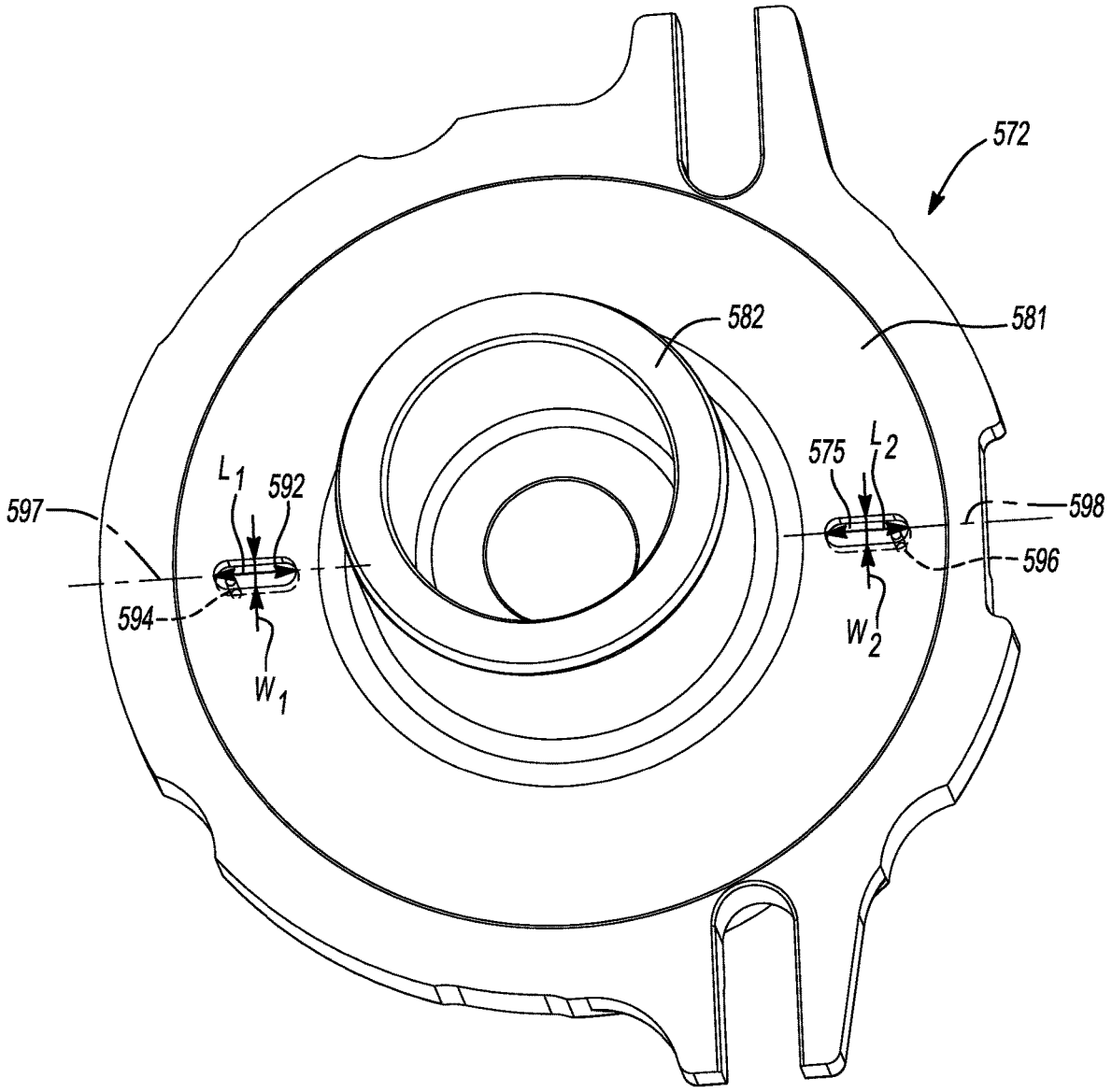
Figure 20:
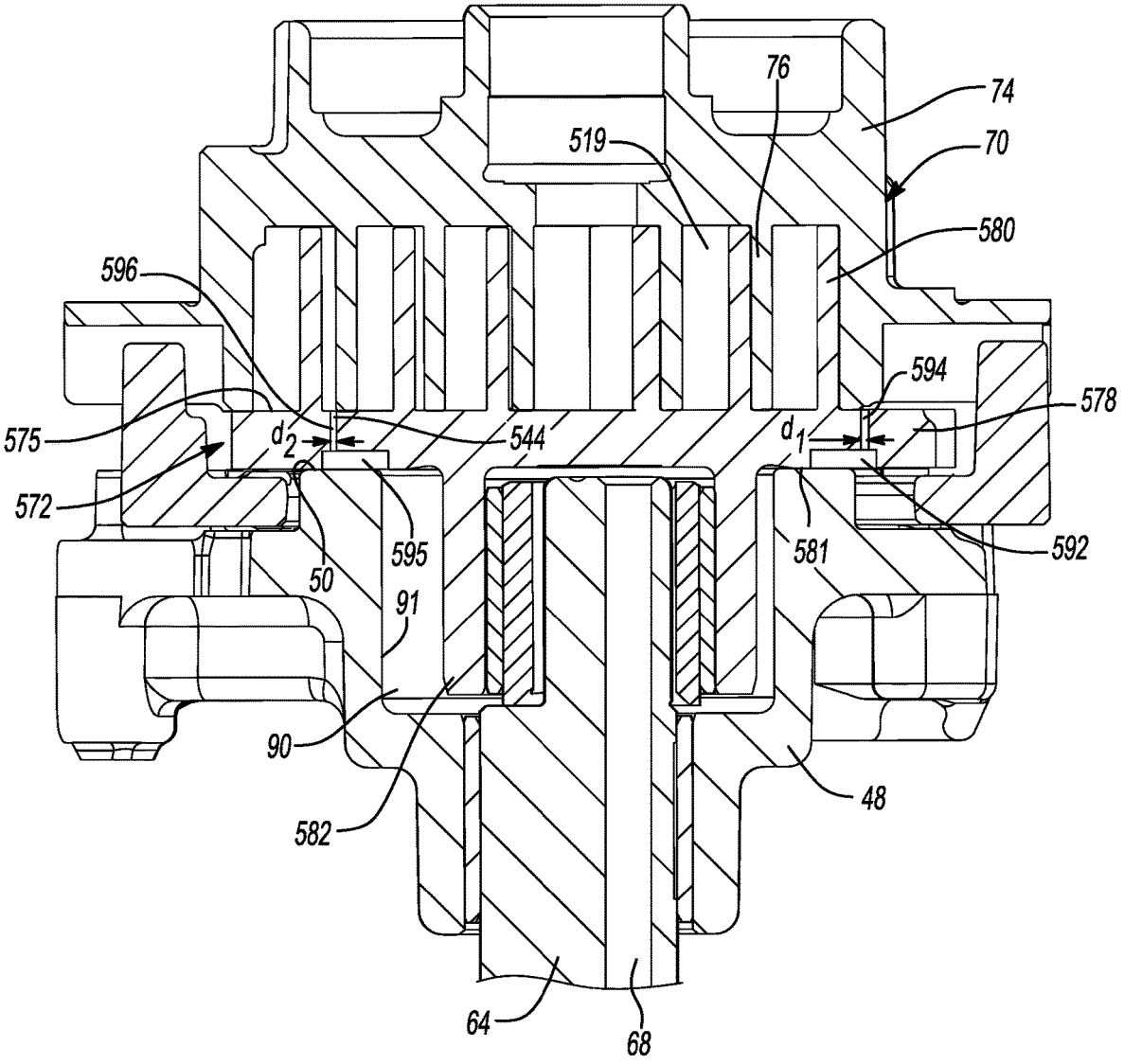
Figure 21:
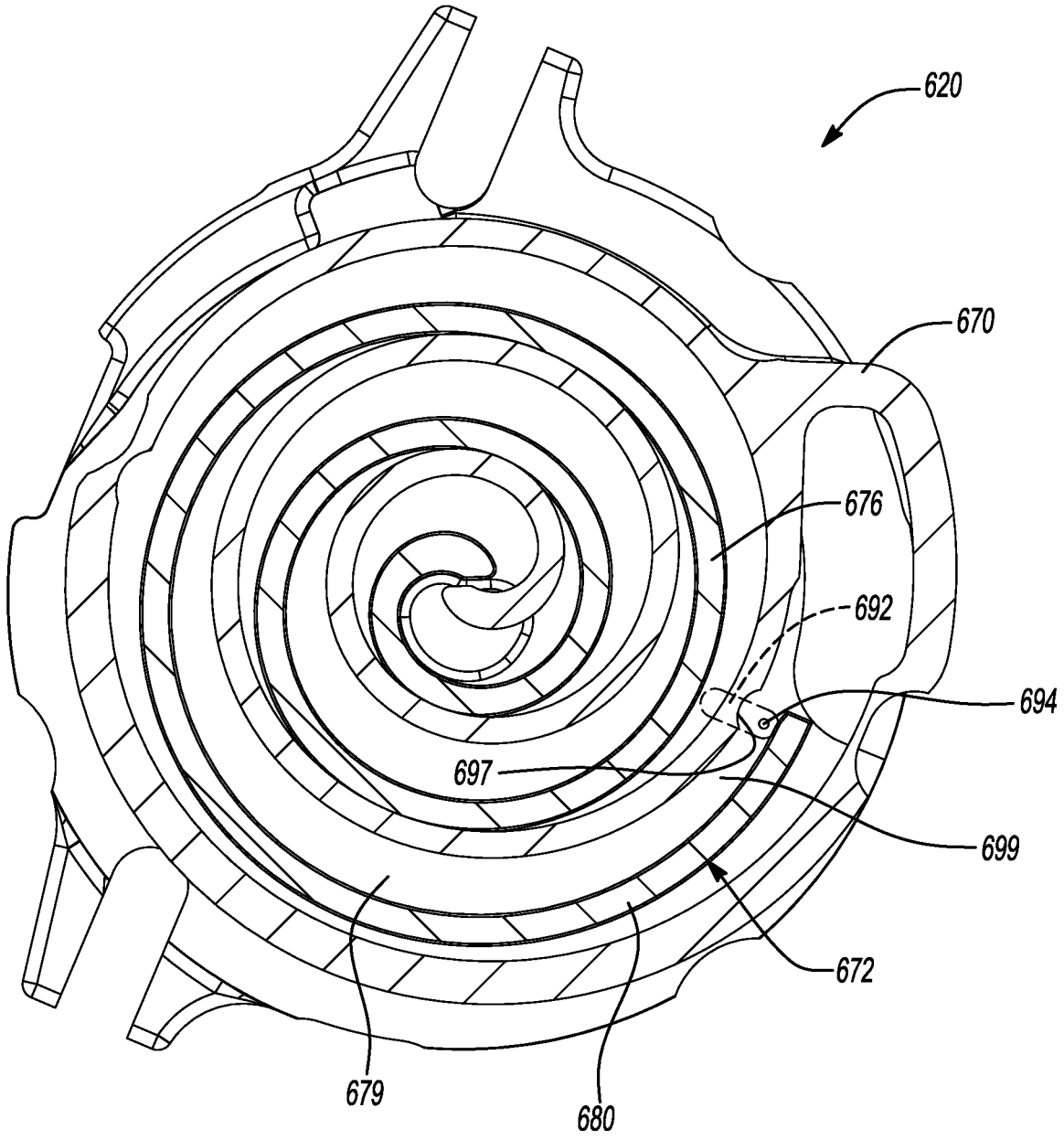
Figure 22:
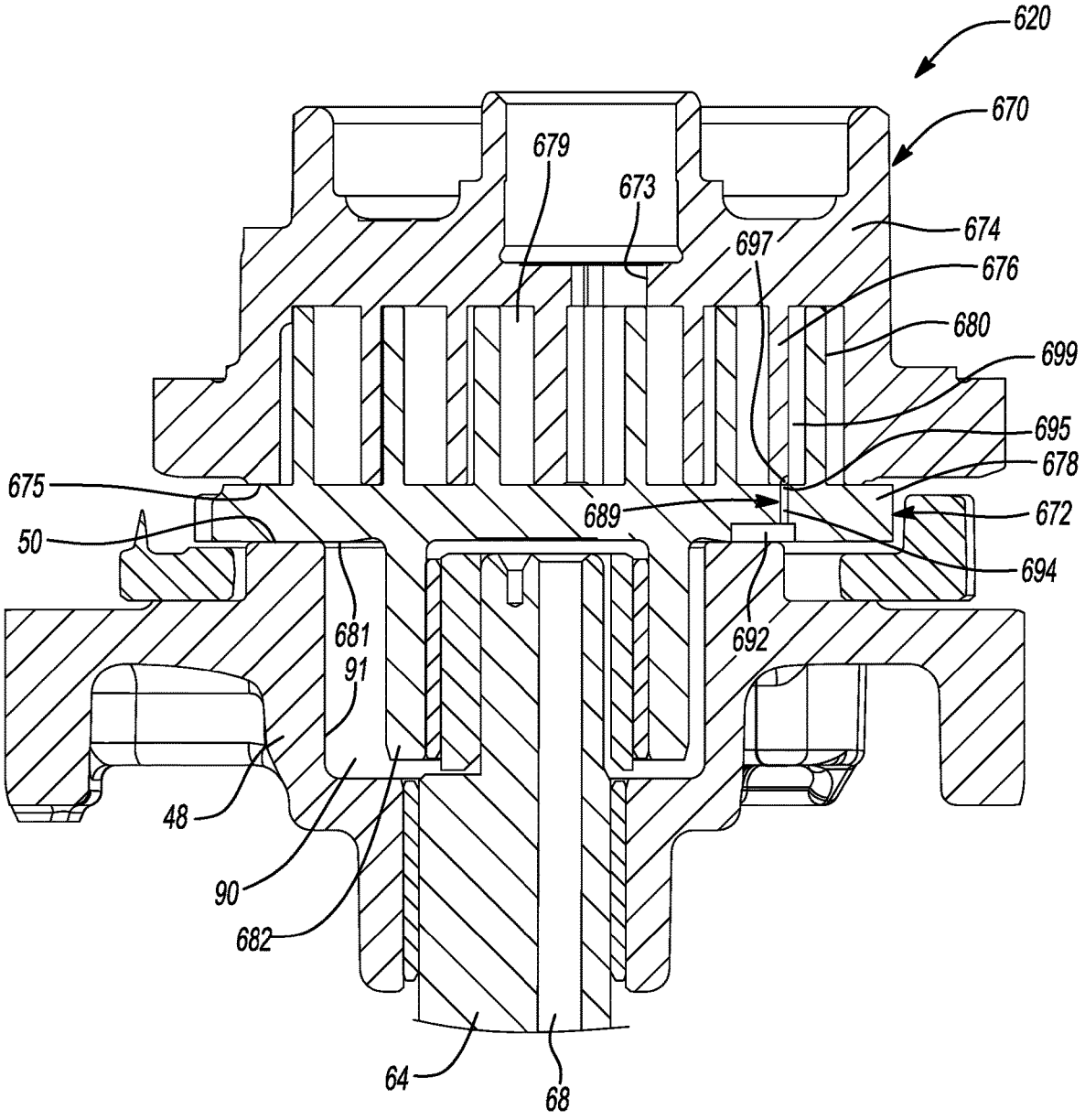
Figure 23:
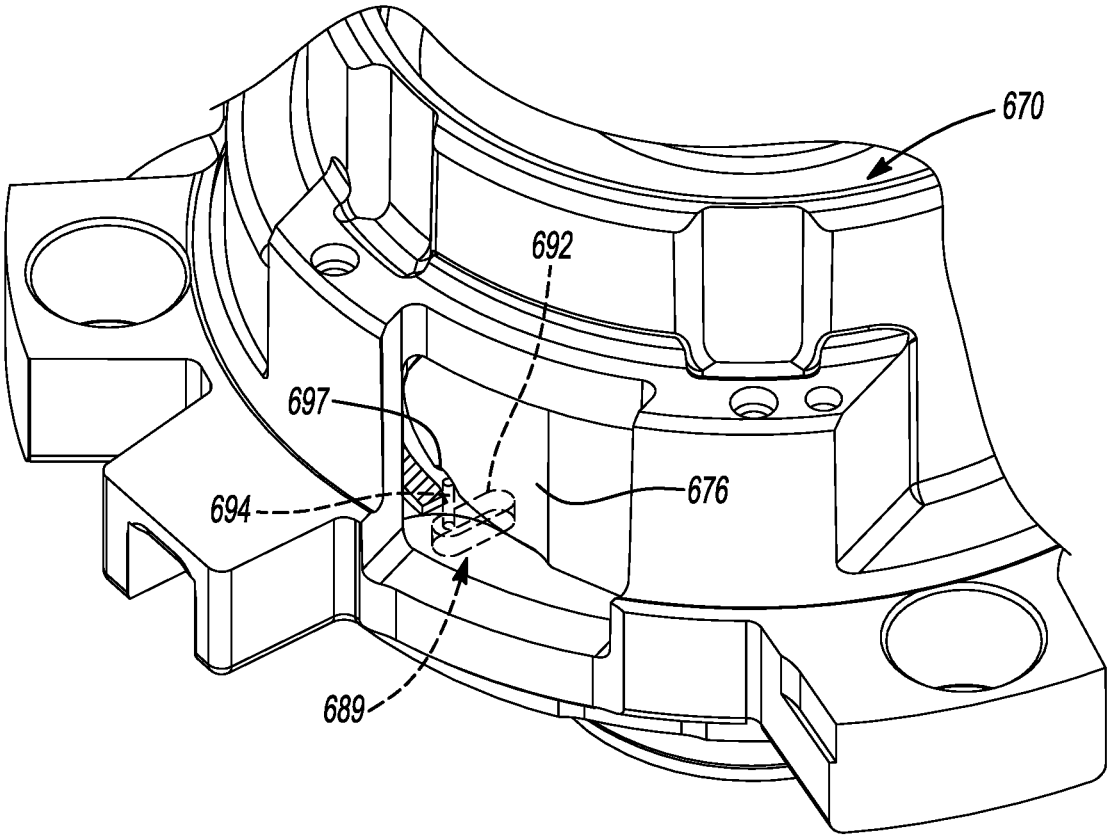

FIG. 8*a* is a cross-sectional view of another compression mechanism;

FIG. 9 is a bottom view of another orbiting scroll that can be incorporated into the compression mechanism of FIG. 1;

FIG. 10 is a cross-sectional view of a compression mechanism including the orbiting scroll shown in FIG. 9;

FIG. 11 is a bottom view of yet another orbiting scroll that can be incorporated into the compression mechanism of FIG. 1;

FIG. 12 is a cross-sectional view of a compression mechanism including the orbiting scroll shown in FIG. 11;

FIG. 12*a* is a bottom view of another orbiting scroll;

FIG. 13 is a cross-sectional view of a compression mechanism including another orbiting scroll;

FIG. 13*a* is a cross-sectional view of another compression mechanism;

FIG. 13*b* is a cross-sectional view of another compression mechanism;

FIG. 14 is another cross-sectional view of the compression mechanism of FIG. 13;

FIG. 15 is a bottom view of the orbiting scroll of FIG. 13;

FIG. 16 is a top view of the orbiting scroll of FIG. 13;

FIG. 17 is a cross-sectional view of a compression mechanism including another orbiting scroll;

FIG. 17*a* is a cross-sectional view of another compression mechanism;

FIG. 18 is a top view of the orbiting scroll of FIG. 17;

FIG. 19 is a bottom view of the orbiting scroll of FIG. 17;

FIG. 20 is another cross-sectional view of the compression mechanism of FIG. 17;

FIG. 21 is a cross-sectional view of another compression mechanism that can be incorporated into the compressor of FIG. 1;

FIG. 22 is a cross-sectional view of the compression mechanism of FIG. 21; and FIG. 23 is a partial perspective view of a portion of the compression mechanism shown in FIG. 21.

Corresponding reference numerals indicate corresponding parts throughout the several views of the drawings.

DETAILED DESCRIPTION

Example embodiments will now be described more fully with reference to the accompanying drawings.

Example embodiments are provided so that this disclosure will be thorough, and will fully convey the scope to those who are skilled in the art. Numerous specific details are set forth such as examples of specific components, devices, and methods, to provide a thorough understanding of embodiments of the present disclosure. It will be apparent to those skilled in the art that specific details need not be employed, that example embodiments may be embodied in many different forms and that neither should be construed to limit the scope of the disclosure. In some example embodiments, well-known processes, well-known device structures, and well-known technologies are not described in detail.

The terminology used herein is for the purpose of describing particular example embodiments only and is not intended to be limiting. As used herein, the singular forms "a," "an," and "the" may be intended to include the plural forms as well, unless the context clearly indicates otherwise. The terms "comprises," "comprising," "including," and "having," are inclusive and therefore specify the presence of stated features, integers, steps, operations, elements, and/or components, but do not preclude the presence or addition of one or more other features, integers, steps, operations, elements, components, and/or groups thereof. The method steps, processes, and operations described herein are not to be construed as necessarily requiring their performance in the particular order discussed or illustrated, unless specifically identified as an order of performance. It is also to be understood that additional or alternative steps may be employed.

When an element or layer is referred to as being "on," "engaged to," "connected to," or "coupled to" another element or layer, it may be directly on, engaged, connected or coupled to the other element or layer, or intervening elements or layers may be present. In contrast, when an element is referred to as being "directly on," "directly engaged to," "directly connected to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

Although the terms first, second, third, etc. may be used herein to describe various elements, components, regions, layers and/or sections, these elements, components, regions, layers and/or sections should not be limited by these terms. These terms may be only used to distinguish one element, component, region, layer or section from another region, layer or section. Terms such as "first," "second," and other numerical terms when used herein do not imply a sequence or order unless clearly indicated by the context. Thus, a first element, component, region, layer or section discussed below could be termed a second element, component, region, layer or section without departing from the teachings of the example embodiments.

Spatially relative terms, such as "inner," "outer," "beneath," "below," "lower," "above," "upper," and the like, may be used herein for ease of description to describe one element or feature's relationship to another element(s) or feature(s) as illustrated in the figures. Spatially relative terms may be intended to encompass different orientations of the device in use or operation in addition to the orientation depicted in the figures. For example, if the device in the figures is turned over, elements described as "below" or "beneath" other elements or features would then be oriented "above" the other elements or features. Thus, the example term "below" can encompass both an orientation of above and below. The device may be otherwise oriented (rotated 90 degrees or at other orientations) and the spatially relative descriptors used herein interpreted accordingly.

As shown in FIG. 1, a compressor 10 is provided and may include a hermetic shell assembly 12, first and second bearing housing assemblies 14, 16, a motor assembly 18, and a compression mechanism 20.

As shown in FIG. 1, the shell assembly 12 may form a compressor housing and may include a cylindrical shell 32, an end cap 34 at an upper end thereof, a transversely extending partition 36, and a base 38 at a lower end thereof. The shell 32, the partition 36, and the base 38 may cooperate to define a suction-pressure chamber 39. The end cap 34 and the partition 36 may define a discharge-pressure chamber 40. The partition 36 may separate the discharge-pressure chamber 40 from the suction-pressure chamber 39. A discharge-pressure passage 43 may extend through the partition 36 to provide communication between the compression mechanism 20 and the discharge-pressure chamber 40. A suction gas inlet fitting 45 may be attached to the shell assembly 12 at an opening in the shell 32. Suction-pressure working fluid (i.e., low-pressure working fluid) may be drawn into the compression mechanism 20 via the suction gas inlet fitting 45 for compression therein.

The first bearing housing assembly 14 may be disposed within the suction-pressure chamber 39 and may be fixed relative to the shell 32. The first bearing housing assembly 14 may include a first main bearing housing 48 and a first bearing 49. The first main bearing housing 48 may house the first bearing 49 therein and may define an annular flat thrust bearing surface 50 on an axial end surface thereof. The first main bearing housing 48 may fixedly engage the shell 32 and may axially support the compression mechanism 20.

As shown in FIG. 1, the motor assembly 18 may be disposed within the suction-pressure chamber 39 and may include a stator 60, a rotor 62 and a drive shaft 64. The stator 60 may be press fit into the shell 32. The rotor 62 may be press fit on the drive shaft 64 and may transmit rotational power to the drive shaft 64. The drive shaft 64 may be rotatably supported by the first and second bearing housing assemblies 14, 16. The drive shaft 64 may include an eccentric crank pin 66 having a crank pin flat, and a lubricant passageway 68. Lubricant may be transmitted through the lubricant passageway 68 from lubricant sump 69 to various compressor component such as the compression mechanism 20, the first bearing housing assembly 14 and/or the second bearing housing assembly 16, for example.

Figure 2:
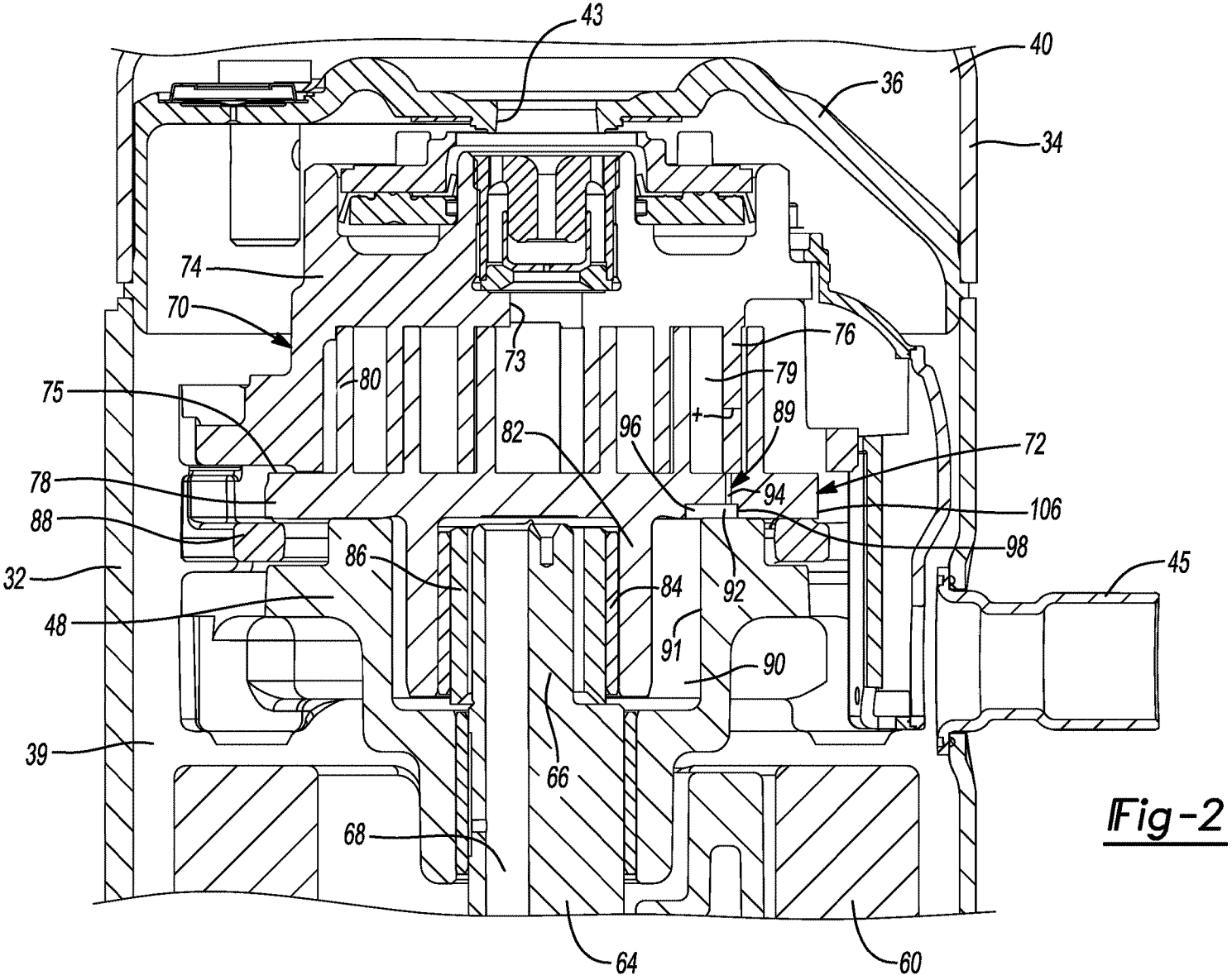
FIG. 2 is a cross-sectional view of a portion of the compressor indicated as area 2 in FIG. 1.

As shown in FIGS. 1 and 2, the compression mechanism 20 may be disposed within the suction-pressure chamber 39 and may include a non-orbiting scroll 70 and an orbiting scroll 72. The first scroll member or non-orbiting scroll 70 may be fixed to the bearing housing 48 and may include an end plate 74 and a spiral wrap 76 projecting downwardly from the end plate 74. The end plate 74 may include a discharge passage 73 that allows discharge gas to flow to the discharge-pressure chamber 40 and out a discharge gas inlet fitting (not shown) attached to the end cap 34.

The second scroll member or orbiting scroll 72 may include an end plate 78 and a spiral wrap 80 on an upper surface 75 thereof and an annular flat thrust surface 81 on the lower surface. The spiral wrap 80 may meshingly engage the spiral wrap 76 of the non-orbiting scroll 70, thereby creating a series of moving fluid pockets 79. The fluid pockets 79 defined by the spiral wraps 76, 80 may decrease in volume as they move from a radially outer position (at a suction pressure) to a radially intermediate position (at an intermediate pressure) to a radially inner position (at a discharge pressure) throughout a compression cycle of the compression mechanism 20. Thrust surface 81 may interface with annular flat thrust bearing surface 50 on the bearing housing 48.

A cylindrical hub 82 may project downwardly from the thrust surface 81 and may include a drive bearing 84 and an unloader bushing 86 disposed therein. The crank pin flat may drivingly engage the inner bore to provide a radially compliant driving arrangement. An Oldham coupling 88 may be engaged with the orbiting scroll 72 and the first bearing housing 48 to prevent relative rotation therebetween.

The end plate 78 may include a lubrication system 89 that provides lubricant to one or more of the fluid pockets 79. That is, lubricant flowing through the lubricant passageway 68 and accumulated in an interior volume 90 of the bearing housing 48 (the interior volume 90 may be formed by the bearing housing 48 and at least partially by the hub 82) may be supplied to the fluid pockets 79 via the lubrication system 89. Stated differently, under the action of centrifugal force generated by the rotation of the driveshaft 64, lubricant may flow from the lubricant sump 69 through the lubricant passageway 68 where it may lubricate components such as the bearing 49, the drive bearing 84, and the unloader bushing 86, for example. A portion of lubricant exiting the lubricant passageway 68 of the driveshaft 64 may then collect in the interior volume 90. Due to the orbital motion of the orbiting scroll 72, lubricant in the interior volume 90 is forced radially outwardly against an inner diametrical wall 91 of the bearing housing 48 and axially upwardly along the inner diametrical wall 91 of the bearing housing 48. A first portion of lubricant moving upwardly along the inner diametrical wall 91 may flow to the lubrication system 89 and may be supplied to the fluid pockets 79. A second portion of lubricant moving upwardly along the inner diametrical wall 91 may accumulate on the flat thrust bearing surface 50 to lubricate the bearing surface 50. A small portion of lubricant accumulated on the bearing surface 50 may also be supplied to the fluid pockets 79 via the lubrication system 89.

Figure 7:
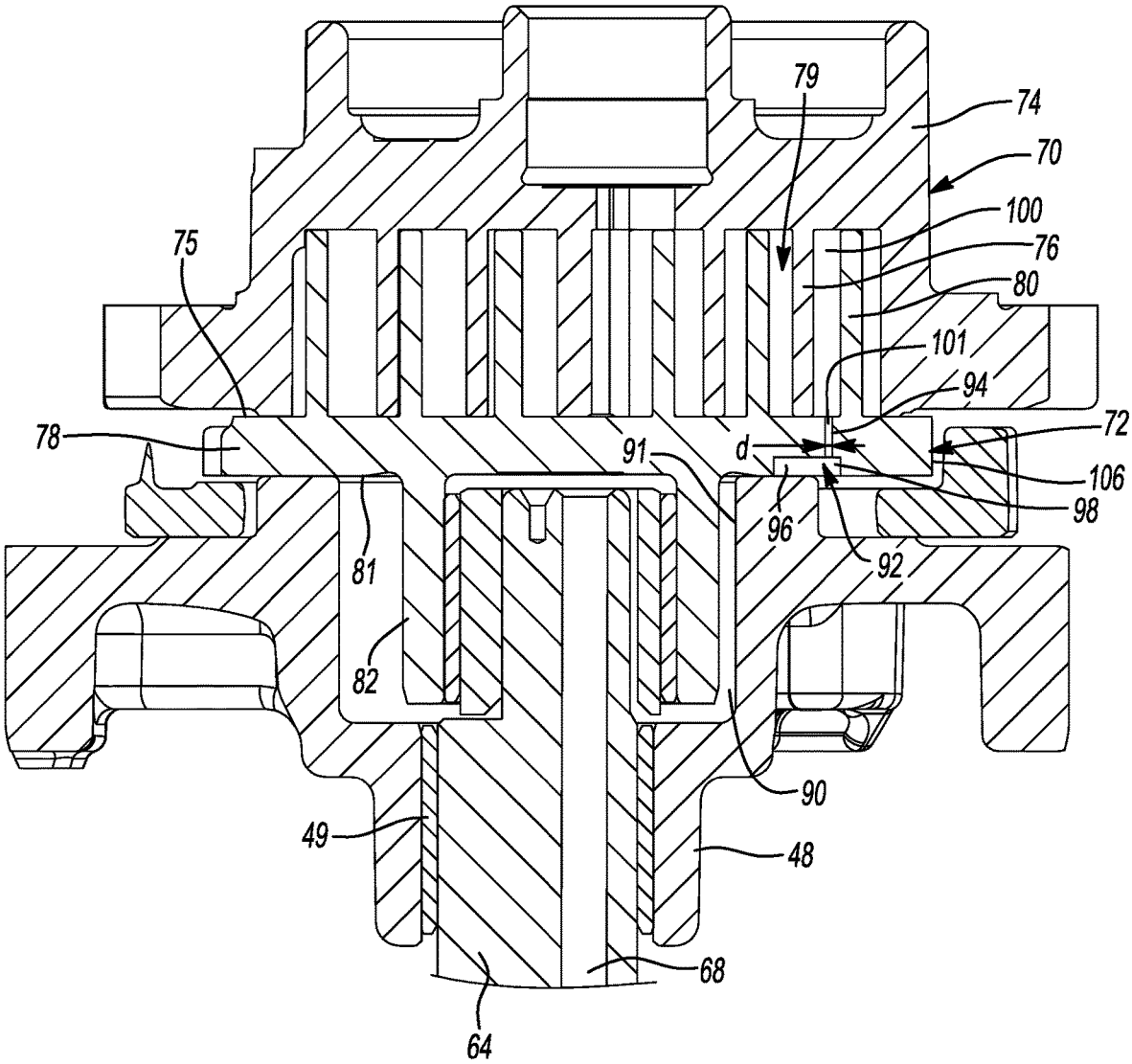
FIG. 7 is a cross-sectional view of the compressor of FIG. 1 with a lubrication system in fluid communication with a suction-pressure chamber.

With reference to FIGS. 1-8, the lubrication system 89 may include an oil or lubricant slot 92 (FIGS. 1-3, 5 and 7) and an oil or lubricant passage 94 (FIGS. 1, 2, 4 and 6-8). The lubricant slot 92 is formed in the thrust surface 81 and oriented in a radial direction. That is, the lubricant slot 92 includes a width W and a length L that is greater than the width W. The length L extends in a radial direction (a longitudinal axis 97 of the lubricant slot 92 extends through the hub 82 and is perpendicular a rotational axis 99 (FIG. 1) of the drive shaft 64). The length L of the lubricant slot 92 is greater than a diameter d of the lubricant passage 94 and the thickness t of the wrap 76. The width W of the lubricant slot 92 (FIG. 5) may be greater than the thickness t of the wrap 76 (FIG. 2) and greater than the diameter d of the lubricant passage 94 (FIG. 7). As shown in FIGS. 1 and 2, the lubricant slot 92 may be in fluid communication with the interior volume 90 for a selected portion of the compression cycle (e.g., 50% of the compression cycle) and may include a first or inner end 96 and a second or outer end 98. The first end 96 extends radially inwardly further than the lubricant passage 94 and the second end 98 extends radially outwardly further than the lubricant passage 94.

When the lubricant slot 92 is in fluid communication with the interior volume 90, working fluid in the suction-pressure chamber 39 is prevented from flowing into the lubricant slot 92 and lubricant that has moved upwardly along the inner diametrical wall 91 is allowed to enter into the lubricant slot 92 via the first end 96. As shown in FIG. 7, when the lubricant slot 92 is fluidly isolated from the interior volume 90, lubricant within the interior volume 90 is prevented from entering into the lubricant slot 92 and working fluid in the suction-pressure chamber 39 is allowed to flow into the lubricant slot 92 via the second end 98 where it mixes with lubricant contained in the lubricant slot 92 prior to flowing into a suction pocket 100 of the fluid pockets 79 via the lubricant passage 94. In this way, the amount of lubricant flowing into the suction pocket 100 may be controlled. In some configurations, the lubricant slot 92 may be in fluid communication with the internal volume 90 and the suction-pressure chamber 39 at the same time for at least a portion of the compression cycle.

The lubricant passage 94 is formed in the end plate 78 of the orbiting scroll 72 and extends in an axial direction (i.e., a direction parallel to a longitudinal axis of the driveshaft 64). The lubricant passage 94 extends from the lubricant slot 92 to the upper surface 75 of the end plate 78 (FIGS. 1 and 2) so that an outlet 101 of the lubricant passage 94 is positioned within the suction pocket 100 adjacent the wrap 80 (FIG. 8; the lubricant passage 94 is positioned adjacent an outer end 102 of the wrap 80). In some configurations, as shown in FIG. 8*a*, the outlet 101*a* of the lubricant passage 94*a* may be positioned upstream of the suction pocket 100*a* (upstream of an outer end 102*a* of wrap 80*a*) instead of being positioned within the suction pocket 100*a*. The lubricant passage 94 is in fluid communication with the lubricant slot 92 and is in selective fluid communication with the suction pocket 100 of the fluid pockets 79. That is, as shown in FIGS. 1 and 2, the wrap 76 of the non-orbiting scroll 70 may block the outlet 101 of the lubricant passage 94 during a portion of the compression cycle to prevent lubricant in the slot 92 from flowing into the suction pocket 100 of the fluid pockets 79.

Figure 3:
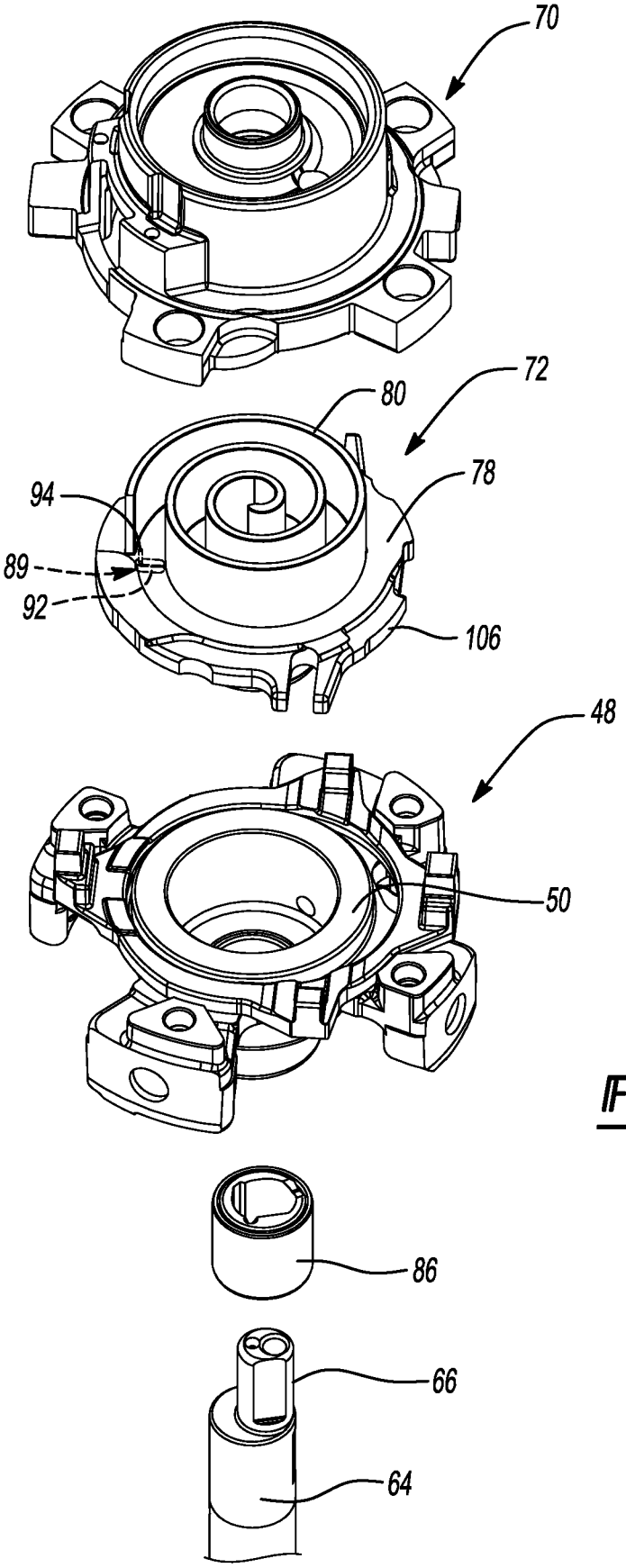
FIG. 3 is an exploded view of a compression mechanism and a bearing housing of the compressor of FIG. 1.
Figure 4:
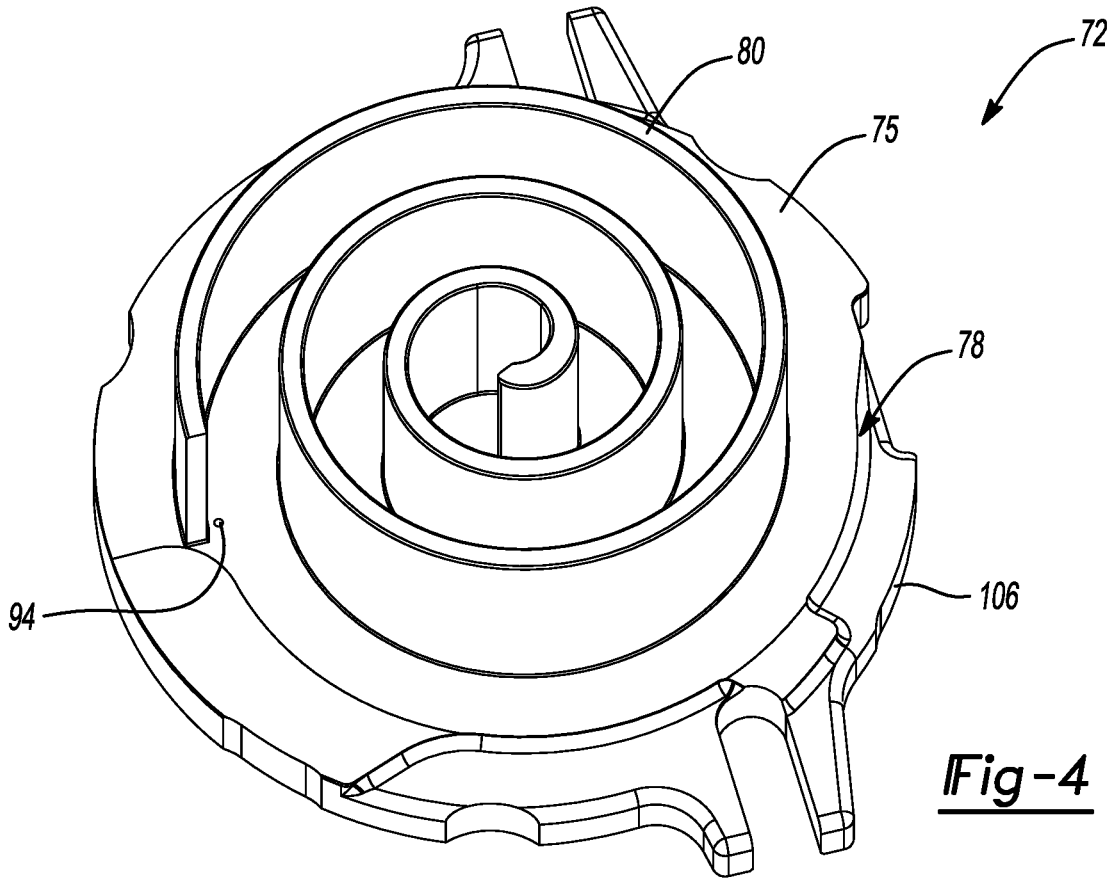
FIG. 4 is a top view of an orbiting scroll of the compression mechanism of FIG. 1.
Figure 5:
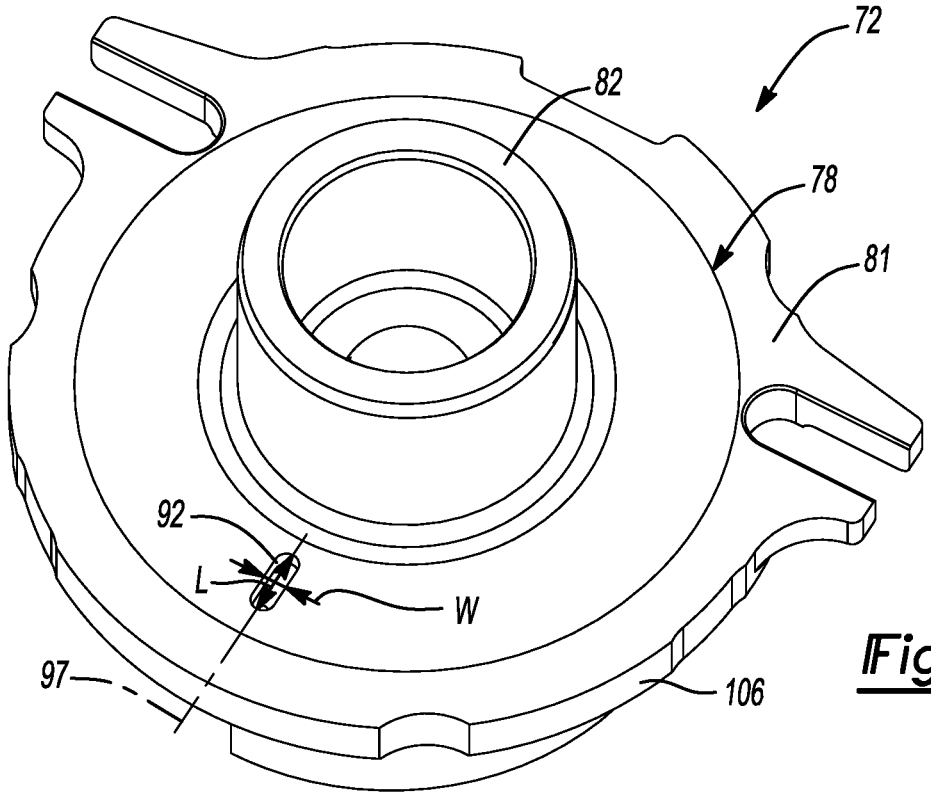
FIG. 5 is a bottom view of the orbiting scroll of the compression mechanism of FIG. 1.
Figure 6:
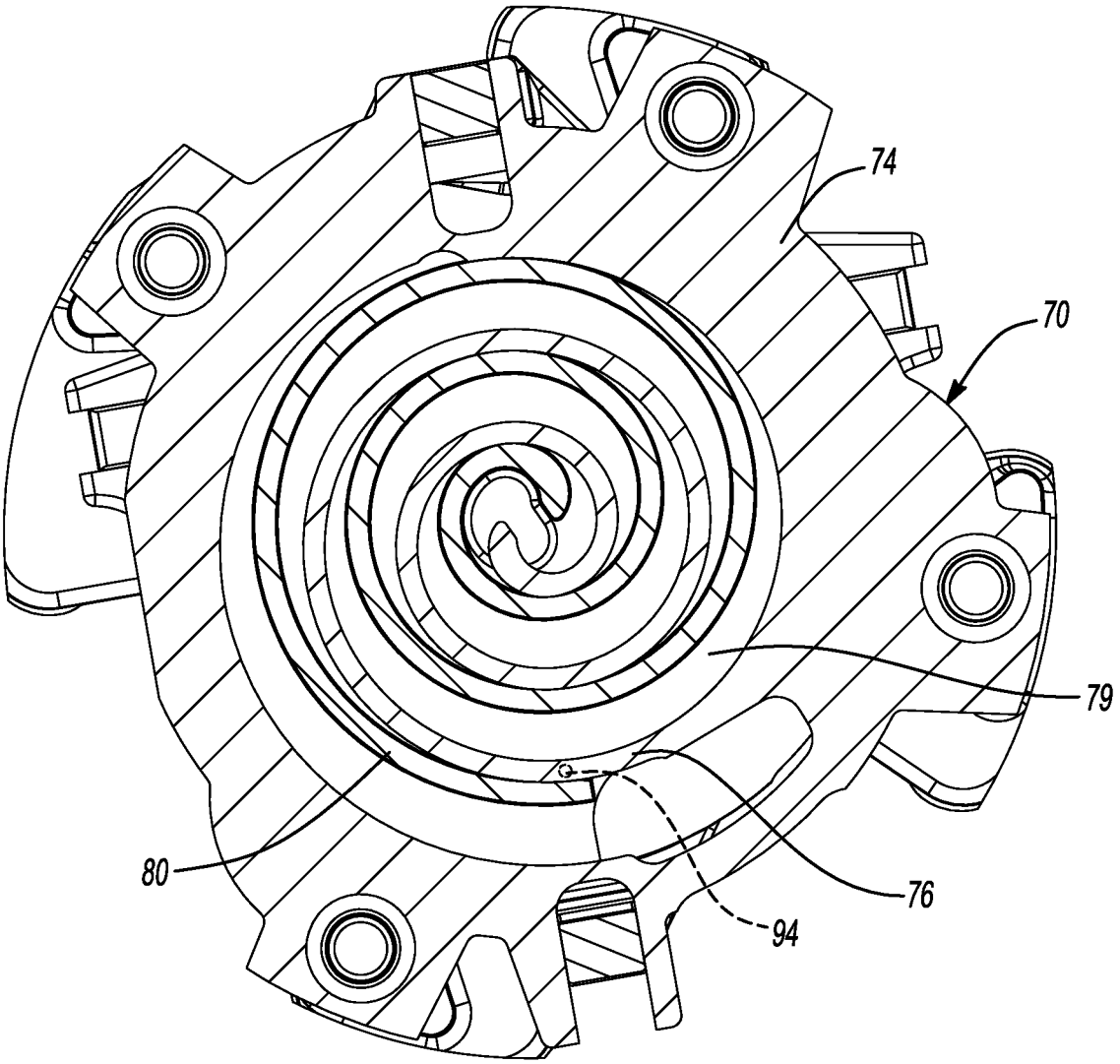
FIG. 6 is a cross-sectional view of the compressor taken along line 6-6 of FIG. 1.

A diameter d of the lubricant passage 94 is smaller than the thickness t of the wall 103 of the wrap 76. The amount of lubricant delivered from the interior volume 90 to the suction pocket 100 may be further controlled via adjusting the diameter d of the lubricant passage 94 and/or the amount of time the lubricant slot 92 is in fluid communication with the interior volume 90. The lubricant slot 92 and the lubricant passage 94 may be positioned radially outwardly relative to the cylindrical hub 82 and radially inwardly relative to an outer diametrical surface 106 of the end plate 78 (FIG. 3).

One benefit of the compressor 10 of the present disclosure is that the lubricant flowing to the fluid pockets 79 via the lubrication system 89 improves efficiency by reducing internal leakage losses during operation of the compressor 10. Another benefit of the compressor 10 of the present disclosure is that the lubricant flowing to the fluid pockets 79 via the lubrication system 89 improves reliability of the compressor 10 at elevated temperatures by lubricating various areas of the wrap 80 of the orbiting scroll 72.

With continued reference to FIGS. 9 and 10, another orbiting scroll 272 is provided. The orbiting scroll 272 may be incorporated into the compression mechanism 20 described above instead of orbiting scroll 72. The structure and function of the orbiting scroll 272 may be similar or identical to that of orbiting scroll 72, apart from the exceptions described below.

The orbiting scroll 272 may include an end plate 278 and a spiral wrap 280 on an upper surface 275 thereof and an annular flat thrust surface 281 on the lower surface. The spiral wrap 280 may meshingly engage the spiral wrap 76 of the non-orbiting scroll 70, thereby creating a series of moving fluid pockets. The fluid pockets defined by the spiral wraps 76, 280 may decrease in volume as they move from a radially outer position (at a suction pressure) to a radially intermediate position (at an intermediate pressure) to a radially inner position (at a discharge pressure) throughout a compression cycle. Thrust surface 281 may interface with annular flat thrust bearing surface 50 on the bearing housing 48. A cylindrical hub 282 may project downwardly from the thrust surface 281.

A lubrication passage 294 may be formed in the end plate 278 and may provide lubricant to one or more of the fluid pockets. The lubricant passage 294 may extend in an axial direction (i.e., a direction parallel to a longitudinal axis of the driveshaft 64) from the flat thrust surface 281 to the upper surface 275. As shown in FIG. 10, the lubricant passage 294 may include an inlet 290 and an outlet 292. The inlet 290 is in communication with the thrust bearing surface 50 of the bearing housing 48 thereby allowing lubricant on the thrust bearing surface 50 to flow into the inlet 290. The outlet 292 is positioned within the suction pocket of the fluid pockets. In this way, lubricant within the lubricant passage 294 may flow into the suction pocket via the outlet 292.

With continued reference to FIGS. 11 and 12, another orbiting scroll 372 is provided. The orbiting scroll 372 may be incorporated into the compression mechanism 20 described above instead of orbiting scrolls 72, 272. The structure and function of the orbiting scroll 372 may be similar or identical to that of orbiting scrolls 72, 272, apart from the exceptions described below.

The orbiting scroll 372 may include an end plate 378 and a spiral wrap 380 on an upper surface 375 thereof and an annular flat thrust surface 381 on the lower surface. The spiral wrap 380 may meshingly engage the spiral wrap 76 of the non-orbiting scroll 70, thereby creating a series of moving fluid pockets. The fluid pockets defined by the spiral wraps 76, 380 may decrease in volume as they move from a radially outer position (at a suction pressure) to a radially intermediate position (at an intermediate pressure) to a radially inner position (at a discharge pressure) throughout a compression cycle. Thrust surface 381 may interface with the annular flat thrust bearing surface 50 on the bearing housing 48. A cylindrical hub 382 may project downwardly from the thrust surface 381.

The end plate 378 may include a lubrication system 389 that provides lubricant to one or more of the fluid pockets. The lubrication system 389 may include an oil or lubricant aperture 392 and an oil or lubricant passage 394. The lubricant aperture 392 is formed in the thrust surface 381 and is circular-shaped. In some configurations, the shape of the lubricant aperture 392 may be triangular, square, rectangular, or any other suitable shape instead of circular. The lubricant aperture 392 may encircle the lubricant passage 394. The lubricant aperture 392 may be in fluid communication with the interior volume 90 for a selected portion of the compression cycle.

When the lubricant aperture 392 is in fluid communication with the interior volume 90, working fluid in the suction-pressure chamber 39 is prevented from flowing into the lubricant aperture 392 and lubricant that has moved upwardly along the inner diametrical wall 91 of the bearing housing 48 is allowed to enter into the lubricant aperture 392. When the lubricant aperture 392 is fluidly isolated from the interior volume 90, lubricant within the interior volume 90 is prevented from entering into the lubricant aperture 392 and working fluid in the suction-pressure chamber 39 is allowed to flow into the lubricant aperture 392 where it mixes with lubricant contained in the lubricant aperture 392 prior to flowing into a suction pocket via the lubricant passage 394.

The lubricant passage 394 is formed in the end plate 378 of the orbiting scroll 372 and extends in an axial direction (i.e., a direction parallel to a longitudinal axis of the driveshaft 64). When the lubricant passage 394 is in fluid communication with the suction pocket, the lubricant passage 394 extends from the lubricant aperture 392 to the upper surface 375 of the end plate 378 so that an outlet 301 of the lubricant passage 394 is positioned within the suction pocket. In some configurations, as shown in FIG. 12*a*, a plurality of lubricant passages 394*a* may be formed in the end plate 378*a* of the orbiting scroll 372*a* and extend from the lubricant aperture 392*a* to the upper surface (not shown) of the end plate 378*a* to provide a greater amount of lubricant to the suction pocket. In other configurations, the lubricant passage 394 may be a different shape (e.g., rectangular) and/or oriented at an angle instead of being oriented vertically from the lubricant aperture 392 to the upper surface 375 of the end plate 378.

With continued reference to FIGS. 13-16, another orbiting scroll 472 is provided. The orbiting scroll 472 may be incorporated into the compression mechanism 20 described above instead of orbiting scrolls 72, 272, 372. The structure and function of the orbiting scroll 472 may be similar or identical to that of orbiting scrolls 72, 272, 372 apart from the exceptions described below.

The orbiting scroll 472 may include an end plate 478 and a spiral wrap 480 on an upper surface 475 thereof and an annular flat thrust surface 481 on the lower surface. The spiral wrap 480 may meshingly engage the spiral wrap 76 of the non-orbiting scroll 70, thereby creating a series of moving fluid pockets 419. The fluid pockets 419 defined by the spiral wraps 76, 480 may decrease in volume as they move from a radially outer position (at a suction pressure) to a radially intermediate position (at an intermediate pressure) to a radially inner position (at a discharge pressure) throughout a compression cycle. Thrust surface 481 may interface with the annular flat thrust bearing surface 50 on the bearing housing 48. A cylindrical hub 482 may project downwardly from the thrust surface 481.

The end plate 478 may include a lubrication system 489 that provides lubricant to one or more of the fluid pockets. The lubrication system 489 may include a first oil or lubricant slot 492 (FIGS. 14-16), a first oil or lubricant passage 494 (FIGS. 14-16), a second oil or lubricant slot 495 (FIGS. 13, 15 and 16), and a second oil or lubricant passage 496 (FIGS. 13, 15 and 16). The first lubricant slot 492 is formed in the thrust surface 481 and is oriented in a radial direction. That is, the first lubricant slot 492 includes a width W1 and a length L1 that is greater than the width W1. The length L1 extends in a radial direction (a longitudinal axis 497 of the first lubricant slot 492 extends through the hub 482 and is perpendicular the rotational axis 99 of the drive shaft 64). The length L1 of the first lubricant slot 492 is greater than a diameter d1 of the first lubricant passage 494 and the thickness t of the wrap 76. The first lubricant slot 492 may be in fluid communication with the interior volume 90 for a selected portion of the compression cycle.

As shown in FIG. 14, when the first lubricant slot 492 is in fluid communication with the interior volume 90, working fluid in the suction-pressure chamber 39 is prevented from flowing into the first lubricant slot 492 and lubricant that has moved upwardly along the inner diametrical wall 91 of the bearing housing 48 is allowed to enter into the first lubricant slot 492. When the first lubricant slot 492 is fluidly isolated from the interior volume 90, lubricant within the interior volume 90 is prevented from entering into the first lubricant slot 492 and working fluid in the suction-pressure chamber 39 is allowed to flow into the first lubricant slot 492 where it mixes with lubricant contained in the first lubricant slot 492 prior to flowing into a suction pocket 420 of the fluid pockets 419 via the first lubricant passage 494.

The first lubricant passage 494 is formed in the end plate 478 of the orbiting scroll 472 and extends in an axial direction. The first lubricant passage 494 extends from the first lubricant slot 492 to the upper surface 475 of the end plate 478 so that an outlet 430 of the first lubricant passage 494 is positioned adjacent the wrap 480. The first lubricant passage 494 is in fluid communication with the first lubricant slot 492 and is in selective fluid communication with the suction pocket 420 of the fluid pockets 419. That is, the wrap 76 of the non-orbiting scroll 70 may block the outlet 430 (FIG. 14) of the first lubricant passage 494 during a portion of the compression cycle to prevent lubricant in the first lubricant slot 492 from flowing into the suction pocket 420 via the first lubricant passage 494.

The second lubricant slot 495 is formed in the thrust surface 481 and spaced apart from the first lubricant slot 492. The second lubricant slot 495 may be in fluid communication with the interior volume 90 for a selected portion of the compression cycle. The second lubricant slot 495 is oriented in a radial direction. That is, the second lubricant slot 495 includes a width W2 and a length L2 that is greater than the width W2. The length L2 extends in a radial direction (a longitudinal axis 498 of the second lubricant slot 495 extends through the hub 482 and is perpendicular the rotational axis 99 of the drive shaft 64). The length L2 of the second lubricant slot 495 is greater than a diameter d2 of the second lubricant passage 496 and the thickness t of the wrap 76. A first end of the second lubricant slot 495 extends radially inwardly further than the second lubricant passage 496 and a second end of the second lubricant slot 495 extends radially outwardly further than the second lubricant passage 496.

When the second lubricant slot 495 is in fluid communication with the interior volume 90, working fluid in the suction-pressure chamber 39 is prevented from flowing into the second lubricant slot 495 and lubricant that has moved upwardly along the inner diametrical wall 91 is allowed to enter into the second lubricant slot 495. As shown in FIG. 13, when the second lubricant slot 495 is fluidly isolated from the interior volume 90, lubricant within the interior volume 90 is prevented from entering into the second lubricant slot 495 and working fluid in the suction-pressure chamber 39 is allowed to flow into the second lubricant slot 495 where it mixes with lubricant contained in the second lubricant slot 495 prior to flowing into the suction pocket 420 of the fluid pockets 419 via the second lubricant passage 496. The second lubricant slot 495 may be in fluid communication with the interior volume 90 during a portion of the compression cycle when the first lubricant slot 492 is fluidly isolated from the interior volume 90, and may be in fluid communication with the suction-pressure chamber 39 during a portion of the compression cycle when the first lubricant slot 492 is in fluid communication with the interior volume 90. In some configurations, as shown in FIG. 13*a*, the second lubricant slot 495*a* may be in fluid communication with the interior volume 90 during a portion of the compression cycle when the first lubricant slot 492*a* is also in fluid communication with the interior volume 90 (the passages 494*a*, 496*a* are in fluid communication with the suction pocket). In some configurations, as shown in FIG. 13*b*, the lubricant slot 492*b* may be in fluid communication with the suction-pressure chamber 39 during a portion of the compression cycle when the lubricant slot 495*b* is in fluid communication with both the suction pressure chamber 39 and the interior volume 90 (the passages 494*b*, 496*b* are in fluid communication with the suction pocket). In this way, an increased amount of lubricant within the interior volume 90 may flow to the suction pocket 420. In some configurations, the lubricant slot 92 may be in fluid communication with the internal volume 90 and the suction-pressure chamber 39 at the same time for at least a portion of the compression cycle.

The second lubricant passage 496 is formed in the end plate 478 of the orbiting scroll 472 and extends in an axial direction. The second lubricant passage 496 extends from the second lubricant slot 495 to the upper surface 475 of the end plate 478 so that an outlet 444 of the second lubricant passage 496 is positioned within the suction pocket 420. The second lubricant passage 496 is in fluid communication with the second lubricant slot 495 and selectively in fluid communication with the suction pocket 420 and may allow lubricant within the second lubricant slot 495 to flow to the suction pocket 420.

With continued reference to FIGS. 17-20, another orbiting scroll 572 is provided. The orbiting scroll 572 may be incorporated into the compression mechanism 20 described above instead of orbiting scrolls 72, 272, 372, 472. The structure and function of the orbiting scroll 572 may be similar or identical to that of orbiting scrolls 72, 272, 372, 472 apart from the exceptions described below.

The orbiting scroll 572 may include an end plate 578 and a spiral wrap 580 on an upper surface 575 thereof and an annular flat thrust surface 581 on the lower surface. The spiral wrap 580 may meshingly engage the spiral wrap 76 of the non-orbiting scroll 70, thereby creating a series of moving fluid pockets 519. The fluid pockets 519 defined by the spiral wraps 76, 580 may decrease in volume as they move from a radially outer position (at a suction pressure) to a radially intermediate position (at an intermediate pressure) to a radially inner position (at a discharge pressure) throughout a compression cycle. Thrust surface 581 may interface with the annular flat thrust bearing surface 50 on the bearing housing 48. A cylindrical hub 582 may project downwardly from the thrust surface 581.

The end plate 578 may include a lubrication system that provides lubricant to one or more of the fluid pockets. The lubrication system may include a first oil or lubricant slot 592, a first oil or lubricant passage 594, a second oil or lubricant slot 595, and a second oil or lubricant passage 596. The first lubricant slot 592 is formed in the thrust surface 581 and is oriented in a radial direction. That is, the first lubricant slot 592 includes a width W1 and a length L1 that is greater than the width W1. The length L1 extends in a radial direction (a longitudinal axis 597 of the first lubricant slot 592 extends through the hub 582 and is perpendicular the rotational axis 99 of the drive shaft 64). The length L1 of the first lubricant slot 592 is greater than a diameter d1 of the first lubricant passage 594 and the thickness t of the wrap 76. The first lubricant slot 592 may be in fluid communication with the interior volume 90 for a selected portion of the compression cycle.

When the first lubricant slot 592 is in fluid communication with the interior volume 90, working fluid in the suction-pressure chamber 39 is prevented from flowing into the first lubricant slot 592 and lubricant that has moved upwardly along the inner diametrical wall 91 is allowed to enter into the first lubricant slot 592. As shown in FIG. 20, when the first lubricant slot 592 is fluidly isolated from the interior volume 90, lubricant within the interior volume 90 is prevented from entering into the first lubricant slot 592 and working fluid in the suction-pressure chamber 39 is allowed to flow into the first lubricant slot 592 where it mixes with lubricant contained in the first lubricant slot 592 prior to flowing into a first suction pocket of the fluid pockets 519 via the first lubricant passage 594.

The first lubricant passage 594 is formed in the end plate 578 of the orbiting scroll 572 and extends in an axial direction. The first lubricant passage 594 extends from the first lubricant slot 592 to the upper surface 575 of the end plate 578. The first lubricant passage 594 is in fluid communication with the first lubricant slot 592 and is in selective fluid communication with the first suction pocket of the fluid pockets 519. That is, as shown in FIG. 20, the wrap 76 of the non-orbiting scroll 70 may block the first lubricant passage 594 during a portion of the compression cycle to prevent lubricant in the first lubricant slot 592 from flowing into the first suction pocket via the first lubricant passage 594.

The second lubricant slot 595 is formed in the thrust surface 581 and diametrically opposed to the first lubricant slot 592 (the second lubricant slot 595 is fluidly isolated from the first lubricant slot 592). The second lubricant slot 595 is oriented radially. That is, the second lubricant slot 595 includes a width W2 and a length L2 that is greater than the width W2. The length L2 extends in a radial direction (a longitudinal axis 598 of the second lubricant slot 595 extends through the hub 582 and is perpendicular the rotational axis 99 of the drive shaft 64). The length L2 of the second lubricant slot 595 is greater than a diameter d2 of the second lubricant passage 596 and the thickness t of the wrap 76. A first end of the second lubricant slot 595 extends radially inwardly further than the second lubricant passage 596 and a second end of the second lubricant slot 595 extends radially outwardly further than the second lubricant passage 596. As shown in FIG. 20, the second lubricant slot 595 may be in fluid communication with the interior volume 90 for a selected portion of the compression cycle.

When the second lubricant slot 595 is in fluid communication with the interior volume 90, working fluid in the suction-pressure chamber 39 is prevented from flowing into the second lubricant slot 595 and lubricant that has moved upwardly along the inner diametrical wall 91 is allowed to enter into the second lubricant slot 595. When the second lubricant slot 595 is fluidly isolated from the interior volume 90, lubricant within the interior volume 90 is prevented from entering into the second lubricant slot 595 and working fluid in the suction-pressure chamber 39 is allowed to flow into the second lubricant slot 595 where it mixes with lubricant contained in the second lubricant slot 595 prior to flowing into a second suction pocket of the fluid pockets 519 via the second lubricant passage 596. In some configurations, as shown in FIG. 17*a*, the second lubricant slot 595*a* may be in fluid communication with the interior volume 90 and the suction-pressure chamber 39 during a portion of the compression cycle when the first lubricant slot 592*a* is in fluid communication with the suction-pressure chamber 39 (the passages 594*a*, 596*a* are in fluid communication with respective suction pockets).

The second lubricant passage 596 is formed in the end plate 578 of the orbiting scroll 572 and extends in an axial direction. The second lubricant passage 596 extends from the second lubricant slot 595 to the upper surface 575 of the end plate 578 so that an outlet 544 of the second lubricant passage 596 is positioned within a second suction pocket (the second suction pocket is different from the first suction pocket) when the second lubricant passage 596 is in fluid communication with the second suction pocket. The second lubricant passage 596 is in fluid communication with the second lubricant slot 595 and in selective fluid communication with the second suction pocket and may allow lubricant within the second lubricant slot 595 to flow to the second suction pocket.

With continued reference to FIGS. 21-23, another compression mechanism 620 is provided. The compression mechanism 620 maybe incorporated into the compressor described above instead of compression mechanism 20. The structure and function of the compression mechanism 620 may be similar or identical to that of the compression mechanism 20, apart from the exceptions described below.

The compression mechanism 620 may include a non-orbiting scroll 670 and an orbiting scroll 672. The first scroll member or non-orbiting scroll 670 may include an end plate 674 and a spiral wrap 676 projecting downwardly from the end plate 674. The end plate 674 may include a discharge passage 673.

The second scroll member or orbiting scroll 672 may include an end plate 678 and a spiral wrap 680 on an upper surface 675 thereof and an annular flat thrust surface 681 on the lower surface. The spiral wrap 680 may meshingly engage the spiral wrap 676 of the non-orbiting scroll 670, thereby creating a series of moving fluid pockets 679. The fluid pockets 679 defined by the spiral wraps 676, 680 may decrease in volume as they move from a radially outer position (at a suction pressure) to a radially intermediate position (at an intermediate pressure) to a radially inner position (at a discharge pressure) throughout a compression cycle of the compression mechanism 620. Thrust surface 681 may interface with annular flat thrust bearing surface 50 on the bearing housing 48. A cylindrical hub 682 may project downwardly from the thrust surface 681.

The end plate 678 may include a lubrication system 689 that provides lubricant to one or more of the fluid pockets 679. The lubrication system 689 may include an oil or lubricant slot 692 and an oil or lubricant passage 694. The lubricant slot 692 is formed in the thrust surface 681 and oriented in a radial direction. The lubricant slot 692 may be in fluid communication with the interior volume 90 for a selected portion of the compression cycle.

When the lubricant slot 692 is in fluid communication with the interior volume 90, working fluid in the suction-pressure chamber 39 is prevented from flowing into the lubricant slot 692 and lubricant that has moved upwardly along the inner diametrical wall 91 is allowed to enter into the lubricant slot 692. As shown in FIG. 22, when the lubricant slot 692 is fluidly isolated from the interior volume 90, lubricant within the interior volume 90 is prevented from entering into the lubricant slot 692 and working fluid in the suction-pressure chamber 39 is allowed to flow into the lubricant slot 692 where it mixes with lubricant contained in the lubricant slot 692 prior to flowing into a suction pocket 699 of the fluid pockets 679 via the lubricant passage 694.

The lubricant passage 694 is formed in the end plate 678 of the orbiting scroll 672 and extends in an axial direction. The lubricant passage 694 extends from the lubricant slot 692 to the upper surface 675 of the end plate 678. The lubricant passage 694 is in fluid communication with the lubricant slot 692 and is in fluid communication with the suction pocket 699 of the fluid pockets 679. That is, an end portion of the wrap 676 of the non-orbiting scroll 670 may include a notch 697 that allows lubricant in the lubricant slot 692 and the lubricant passage 694 to flow into the suction pocket 699 when the wrap 676 blocks the outlet 695 of the lubricant passage 694.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A compressor comprising:

a shell defining a chamber;

a first scroll member disposed within the chamber and including a first end plate and a first scroll wrap extending therefrom;

a second scroll member disposed within the chamber and including a second end plate having a first surface, a second surface, and an oil passage, the first surface having a second scroll wrap meshingly engaging the first scroll wrap to define fluid pockets therebetween, the second surface opposite the first surface and including an oil slot, the oil passage in fluid communication with the oil slot and in fluid communication with one of the fluid pockets; and a bearing housing axially supporting the second scroll member and cooperating with the second scroll member to define an interior volume, wherein the second scroll member is movable between a first position in which lubricant in the interior volume is allowed to flow into the oil passage via the oil slot during operation of the compressor, and a second position in which lubricant in the interior volume is restricted from flowing to the oil passage via the oil slot during operation of the compressor, and wherein the first scroll wrap is positioned over the oil passage when the second scroll member is in the first position to prevent lubricant in the oil passage from entering into the fluid pockets.

2. The compressor of claim 1, wherein a diameter of the oil passage is less than a thickness of the first scroll wrap.

3. The compressor of claim 1, wherein an outlet of the oil passage is positioned at an outer end of the second scroll wrap.

4. The compressor of claim 1, wherein the oil passage is in selective fluid communication with a suction pocket of the fluid pockets.

5. The compressor of claim 1, wherein the interior volume is in fluid communication with the oil slot during a selected portion of a compression cycle of the first scroll member and the second scroll member.

6. The compressor of claim 1, wherein the second scroll member includes a hub extending from the second surface of the second end plate, wherein the hub and the bearing housing cooperate to define the interior volume, and wherein the oil slot and the oil passage are positioned radially outwardly relative to the hub.

7. The compressor of claim 1, wherein an end portion of the first scroll wrap includes a notch formed therein, and wherein the oil passage is in fluid communication with the one of the fluid pockets via the notch when the end portion of the first scroll wrap is positioned over the oil passage.

8. The compressor of claim 1, wherein the one of the fluid pockets is a suction pocket, and wherein an outlet of the oil passage is positioned upstream of the suction pocket.

9. The compressor of claim 1, wherein a plurality of oil passages are in fluid communication with the oil slot and in fluid communication with the one of the fluid pockets.

* * * * *